US010981747B2

(12) United States Patent
Kobayashi

(10) Patent No.: US 10,981,747 B2
(45) Date of Patent: Apr. 20, 2021

(54) APPARATUS FOR PROCESSING SHEETS AND APPARATUS FOR FORMING IMAGES PROVIDED WITH THE APPARATUS

(71) Applicant: Misao Kobayashi, Kofu (JP)

(72) Inventor: Misao Kobayashi, Kofu (JP)

(73) Assignee: CANON FINETECH NISCA INC., Misato (JP)

( * ) Notice: Subject to any disclaimer, the term of this patent is extended or adjusted under 35 U.S.C. 154(b) by 37 days.

(21) Appl. No.: 15/620,342

(22) Filed: Jun. 12, 2017

(65) Prior Publication Data

US 2017/0362048 A1 Dec. 21, 2017

(30) Foreign Application Priority Data

Jun. 15, 2016 (JP) ..... JP2016-118492
Jun. 15, 2016 (JP) ..... JP2016-118641
Jun. 15, 2016 (JP) ..... JP2016-118642
Jun. 29, 2016 (JP) ..... JP2016-128331

(51) Int. Cl.
*B65H 37/04* (2006.01)
*B31F 5/02* (2006.01)
(Continued)

(52) U.S. Cl.
CPC ..... *B65H 37/04* (2013.01); *B31F 5/02* (2013.01); *B42B 2/02* (2013.01); *B42B 5/00* (2013.01); *B65H 31/02* (2013.01); *G03G 15/6544* (2013.01); *B65H 2301/4212* (2013.01); *B65H 2301/4213* (2013.01);
(Continued)

(58) Field of Classification Search
CPC .. B31F 5/003; B31F 5/001; B31F 5/02; B41F 5/001
See application file for complete search history.

(56) References Cited

U.S. PATENT DOCUMENTS 6,145,825 A * 11/2000 Kunihiro ..... B42C 1/12 227/29
8,246,033 B2 * 8/2012 Sato ..... B42C 1/12 270/58.07
(Continued)

FOREIGN PATENT DOCUMENTS

JP 2012-027118 A 2/2012
JP 2015-009956 A 1/2015
(Continued)

*Primary Examiner* — Jennifer E Simmons
(74) *Attorney, Agent, or Firm* — Manabu Kanesaka

(57) ABSTRACT

The present apparatus includes a placement tray to place sheets to undergo binding processing, and a press bind unit shifting along an end edge of sheets on the placement tray. The press bind unit includes a receiving tooth, and pressing teeth meshing with the receiving tooth to perform press binding on sheets nipped therebetween, and the pressing teeth are provided to shift between a press position for meshing with the receiving tooth, and a retract position spaced apart from the receiving tooth so as to shift the press bind unit along the end edge of sheets with the sheets disposed between the receiving tooth and the pressing teeth. By shifting the pressing teeth to the retract position, it is possible to shift the sheet bind apparatus smoothly along the end edge of a bunch of sheets with the sheets disposed between the receiving tooth and the pressing teeth.

20 Claims, 21 Drawing Sheets

(51) Int. Cl.

| | |
|---|---|
| ***B42B 2/02*** | (2006.01) |
| ***G03G 15/00*** | (2006.01) |
| ***B42B 5/00*** | (2006.01) |
| ***B65H 31/02*** | (2006.01) |

(52) U.S. Cl.
CPC ..... *B65H 2301/51616* (2013.01); *B65H 2405/11151* (2013.01); *B65H 2801/27* (2013.01); *G03G 2215/00852* (2013.01)

(56) References Cited

U.S. PATENT DOCUMENTS

| | | | | |
|---|---|---|---|---|
| 8,297,610 | B2 | 10/2012 | Shiraishi | |
| 9,283,797 | B2 | 3/2016 | Tanaka et al. | |
| 2011/0233844 | A1* | 9/2011 | Shiraishi | B42B 5/00 270/58.11 |
| 2015/0037119 | A1* | 2/2015 | Tanaka | B42B 5/00 412/33 |
| 2015/0183610 | A1* | 7/2015 | Matsuki | B65H 37/04 270/58.08 |
| 2015/0353316 | A1 | 12/2015 | Abe | |
| 2015/0360899 | A1* | 12/2015 | Takahashi | B65H 31/26 270/58.08 |
| 2017/0101285 | A1* | 4/2017 | Ishihara | B31F 5/001 |

FOREIGN PATENT DOCUMENTS

| | | | |
|---|---|---|---|
| JP | 2015-030584 | A | 2/2015 |
| JP | 2016-010968 | A | 1/2016 |

* cited by examiner

APPARATUS FOR PROCESSING SHEETS AND APPARATUS FOR FORMING IMAGES PROVIDED WITH THE APPARATUS

BACKGROUND OF THE INVENTION

1. Field of the Invention

The present invention relates to a sheet processing apparatus for performing binding processing on sheets in the shape of a bunch, and more specifically, to a sheet processing apparatus which performs press binding processing for pressing a bunch of sheets to bind, and further preferably, which is capable of also performing needle binding processing for binding a bunch of sheets using a needle, and an image formation apparatus provided with the sheet processing apparatus.

2. Description of the Related Art

Conventionally, in image formation apparatuses such as a copier, laser beam printer, facsimile and complex apparatus thereof, there have been apparatuses provided with sheet processing apparatuses for performing various types of sheet processing such as binding processing on sheets with images formed. In such an image formation apparatus, in the case of binding a bunch of sheets with the sheet processing apparatus, it is general to bind a bunch of sheets using a staple made of metal.

However, in peeling a bunch of sheets subjected to binding processing using a staple, since it is necessary to remove the staple, work is not only burdensome, but also the sheet is easy to be broken. Therefore, a needleless binding mechanism is also known where a bunch of sheets is pressed with a press mechanism to mutually deform the sheets, and is bound, and it is possible to easily peel a bunch of thus press-bound sheets.

In Japanese Patent Application Publication No. 2016-10968 is disclosed a press bind mechanism where upper teeth and lower teeth are obliquely attached to a rotating shaft of an arm for supporting teeth, and gradually mesh with one another. According to this mechanism, since a bunch of sheets is gradually deformed along the rotation center of a support portion and is bound, in nipping sheets to start meshing, as shown in FIG. 13(*a*) of the Publication No. 2016-10968, pressing is started from a beginning side, and it is thereby possible to reduce a maximum load required for press binding.

In Japanese Patent Application Publication No. 2015-9956, with respect to a needleless unit (needleless bind means) fixed to the rear side of an apparatus, in shifting a bunch of sheet to guide to the needleless unit, a tray inclined guide and upper teeth inclined guide are respectively provided to guide a bunch of sheets to between upper teeth and lower teeth. In this needleless binding, as shown in FIGS. 13 and 14 of the Publication No. 2015-9956, since the needleless unit is fixed and the number of binding sheets is low, it is possible to nip sheets relatively smoothly.

Further, a sheet processing apparatus is known which is equipped with a needle bind unit and press bind unit as a single bind apparatus so as to perform needle binding on a bunch of sheets in the case where the number of sheets to bind is high (for example, about 11 to 50) and to perform press binding in the case where the number is low (for example, about several).

For example, in an image formation apparatus of Japanese Patent Application Publication No. 2012-27118, a press bind unit with a relatively wide width and a needle bind unit (stapler) with a width narrower than the wide width are provided together, and are shifted integrally along a sheet end edge. Further, in a sheet processing apparatus of Japanese Patent Application Publication No. 2015-30584, a press binding member is provided so as to cover a needle binding member that rotates, and is configured to rotate about another shaft different from that of the needle binding member as the center, and the same drive motor is switched to perform press binding or needle binding.

SUMMARY OF THE INVENTION

Generally, the needle bind unit is provided with an opening portion with a wide opening so as to bind the relatively high number of sheets as described above, and it is possible to shift the apparatus to a desired bind position along the end edge of sheets with the sheets placed in the opening portion. On the other hand, in the press bind unit, since the number of sheets capable of being bound at a time is low, a relatively narrow distance between the teeth is enough in receiving sheets. Conversely, when the distance between the teeth is too large, there is the risk that flutters of the sheet front end portion occur on the contrary.

Therefore, herein, it is a first object to provide an apparatus provided with a press bind unit capable of shifting in a width direction along an end edge of sheets with the sheets to undergo binding processing placed.

In order to attain the above-mentioned first object, it is disclosed herein that an apparatus is provided with a placement tray to place sheets to undergo binding processing, and a press bind unit capable of shifting along an end edge of sheets on the placement tray, the press bind unit includes a receiving tooth, and a pressing tooth which meshes with the receiving tooth to perform press binding on the sheets nipped therebetween, and that the pressing tooth is provided to be able to shift between a press position for meshing with the receiving tooth, and a retract position spaced apart from the receiving tooth so as to shift the press bind unit along the end edge of sheets with the sheets disposed between the receiving tooth and the pressing tooth.

Further, it is a second object to provide an apparatus which shifts a sheet guide for guiding a sheet in conjunction with a pressing tooth up-and-down shift also in carrying the sheet in a press bind unit for binding a bunch of sheets with the pressing tooth, and which is capable of stably carrying the sheet in a press position without requiring particular drive for a shift of the sheet guide.

In order to attain the above-mentioned second object, it is disclosed that the press bind unit is provided with a receiving portion including an opening to receive a part of a bunch of placed sheets, pressing teeth that press from the frontside and backside of a bunch of sheets received in the receiving portion in a bind position to crimp the sheets, and a sheet guide provided in the receiving portion to guide a sheet to carry in to the bind position, and that the sheet guide is held to shift between a guide position for narrowing the opening to carry the sheet in the bind position and an expanded position with an opening wider than the opening, in conjunction with a shift in a pressing direction of the pressing teeth.

In addition, it is a third object to provide an apparatus for expanding a bind opening at the time of shifting when the bind unit for shifting along a sheet edge shifts along a sheet end edge, and thereby reducing the occurrence of a jam caused by catching a sheet due to a unit shift.

In order to attain the above-mentioned third object, it is disclosed herein that a sheet processing apparatus is comprised of a bind unit that shifts along an end edge of a bunch of sheets placed on a placement tray, the bind unit is provided with a receiving portion including an opening to receive a part of a bunch of placed sheets, a bind portion that binds the bunch of sheets received in the receiving portion in a bind position, and a sheet guide provided in the receiving portion to guide a bunch of sheets to carry in to the bind position, and that the sheet guide is able to be positioned in a guide position for narrowing the opening to carry in the sheets and in an expanded position with an opening wider than the opening, and when the bind unit shifts along the end edge of a bunch of sheets, is positioned in the expanded position.

Further, it is a fourth object to provide an apparatus for shortening a separation distance between a pressing tooth and a receiving tooth to enable processing time of press binding to be reduced, in the case of performing sheet carry-in in a press bind position smoothly, while performing press binding in a different position of the same bunch of sheets once subjected to press binding.

In order to attain the above-mentioned fourth object, it is disclosed herein that a press bind unit is able to shift along an end edge of a bunch of sheets on a placement tray, and is provided with a receiving tooth, and a pressing tooth which meshes with the receiving tooth to perform press binding on the bunch of sheets nipped therebetween, and that the pressing tooth includes a press position for meshing with the receiving tooth, and a sheet receiving position spaced a predetermined distance away from the receiving tooth to receive the sheets in between the receiving tooth and the pressing tooth, and in the case of displacing the press position after pressing the bunch of sheets to perform multiple press binding, is shifted to an intermediate position between the press position and the sheet receiving position.

DESCRIPTION OF THE EMBODIMENTS

Figure 1:
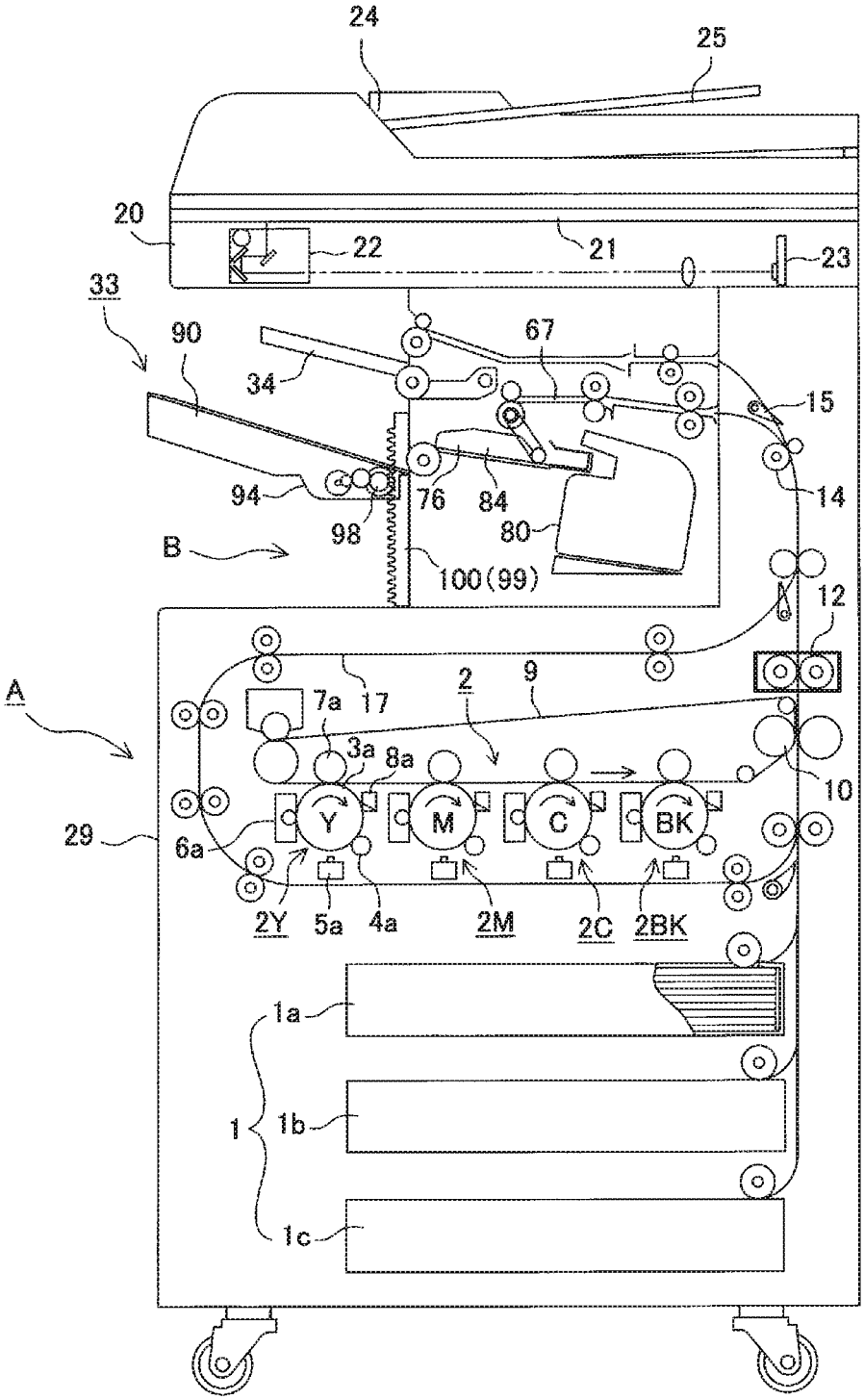
FIG. 1 is an entire configuration view of an image formation system provided with a sheet processing apparatus in an Embodiment of the present invention.

Referring to accompanying drawings, preferred Embodiments of the present invention will be described below in detail. In addition, in the accompanying drawings, through the entire present Description, similar components are assigned the same reference numerals to represent.

FIG. 1 schematically illustrates an entire configuration of an image formation system comprised of an image formation apparatus A and sheet processing apparatus B according to the present invention. The sheet processing apparatus B is to collate a plurality of sheets with images formed in the image formation apparatus A, and perform binding processing on a bunch of collected sheets ST. In addition, in the present Description, the front side of the image formation system of FIG. 1 i.e. the side facing a user of the image formation system is referred to as the front side, and the back side is referred to as the rear side.

[Image Formation Apparatus A]

In the image formation apparatus A shown in FIG. 1 are disposed a paper feed section 1 comprised of three-stage paper feed cassettes 1*a*, 1*b*, 1*c* to store sheets below an image formation section 2 using an electrophotographic scheme, and when the sheet processing apparatus B is not inserted, with space above the image formation section 2 being sheet discharge space, an image reading apparatus 20 is disposed above the space. Accordingly, when the sheet processing apparatus B is disposed, the apparatus is the so-called in-body type using the sheet discharge space as shown in the figure.

The image formation section 2 adopts a tandem scheme using an intermediate transfer belt. In other words, color components of four colors (yellow 2Y, magenta 2M, cyan 2C and black 2BK) are used. For example, in yellow 2Y, the section 2 has a photoconductor drum 3*a* as an image support body, a charging apparatus 4*a* comprised of a charging roller that charges the photoconductor drum 3*a*, and an exposure apparatus 5*a* that makes an image signal read with the image reading apparatus 20 a latent image.

Further, the section 2 is provided with a development apparatus 6*a* that forms the latent image formed on the photoconductor drum 3*a* as a toner image, and a first transfer roller 7*a* that first-transfers the image on the photoconductor drum 3*a* formed by the development apparatus 6*a* to an intermediate transfer belt 9. By this configuration, the image is first-transferred to the intermediate transfer belt 9 for each color component. Then, the color component left on the photoconductor drum 3*a* is collected by a photoconductor cleaner 8*a* to prepare for next image formation. These schemes are the same as in the other color components.

In addition, the image of the intermediate transfer belt 9 is transferred to a sheet fed from the paper feed section 1 by a second-transfer roller 10, and the image is fused to the sheet by pressurized force and heat by a fusing apparatus 12. The remaining superimposed color components on the intermediate transfer belt 9 are removed by an intermediate belt cleaner to prepare for next transfer.

Thus image-formed sheet is discharged to the sheet processing apparatus B from a discharge roller 14. When image formation is performed on both sides of a sheet, the sheet once transported to the sheet processing apparatus B side with a switch gate 15 is switched back, transported to a circulation path 17, and is fed to the image formation section 2 again to form an image on the backside of the sheet. Then, the sheet with the image thus formed on one side or both sides is transported to the sheet processing apparatus B through the discharge roller 14.

The image reading apparatus 20 is disposed above the sheet discharge space above the image formation section 2. Herein, an original document placed on an original document stacker 25 is fed to platen 21 with an original document feeding apparatus 24, the fed original document is sequentially read with a photoelectric converter (for example, CCD) by irradiating using a scan unit 22, and the image is stored in a data storage section not shown. The stored image is formed on the sheet in the image formation section 2 as described above.

[Sheet Processing Apparatus]

Figure 2:
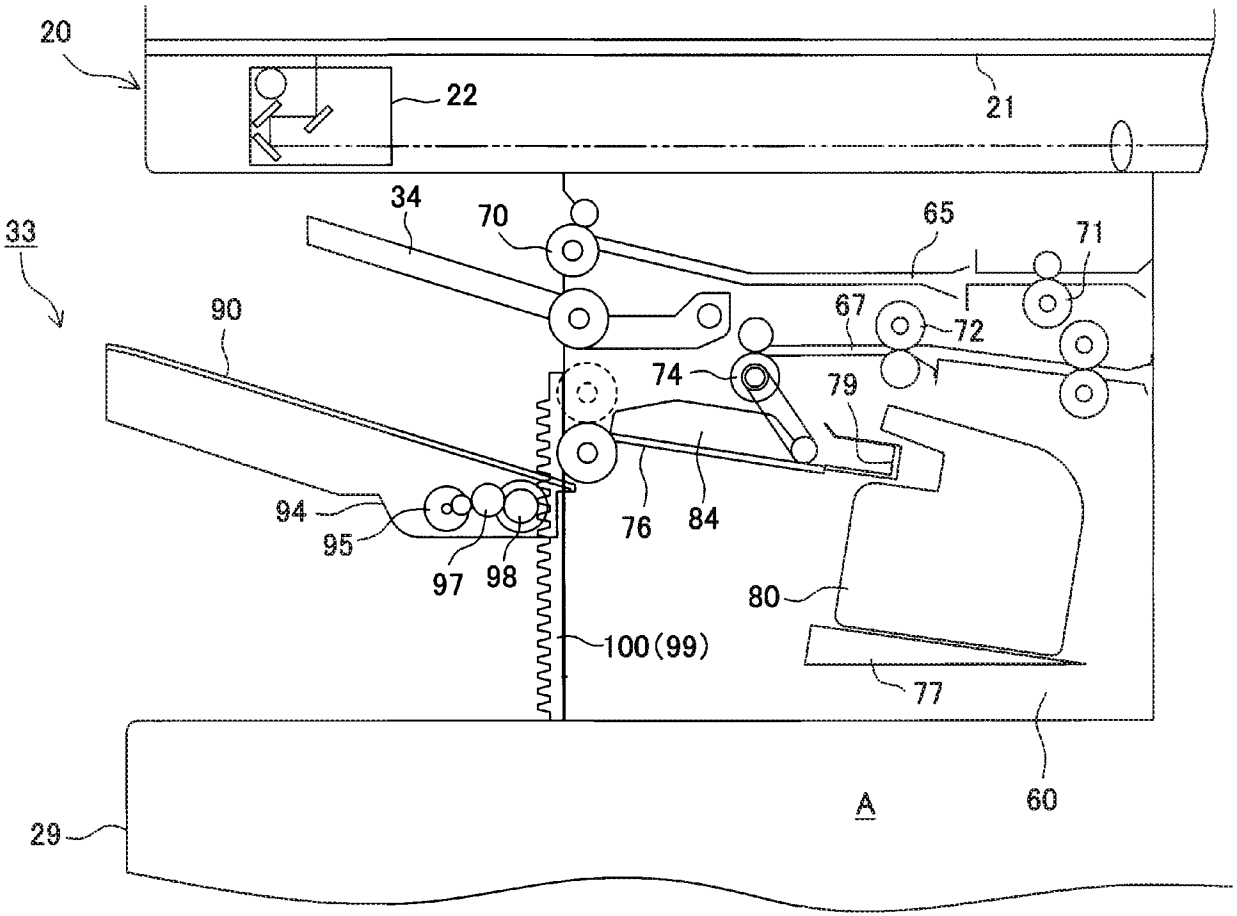
FIG. 2 is an enlarged view illustrating the sheet processing apparatus of FIG. 1.

The sheet processing apparatus B is disposed in the sheet discharge space below the image reading apparatus 20, above the image formation section 2. Then, as shown in FIG. 2, the sheet processing apparatus B is comprised of a switchback path 65, a sheet discharge path 67 for transporting an image-formed sheet sequentially fed from the image formation section 2 to perform sheet binding, a processing tray 76 acting as a placement tray to which the sheet from the sheet discharge path 67 is temporarily introduced to place, a sheet bind unit 80 that binds a bunch of sheets ST (shown in FIG. 3) placed on the processing tray 76, and a tray unit 33 having a collection tray 90 which collects the bunch of sheets ST bound in the sheet bind unit 80 or discharged sheets without being bound and moves up and down. These apparatuses will be described below.

[Switchback Path]

As shown in FIG. 2, in the switchback path 65, a transport roller 71 is disposed on the entrance side, a discharge roller 70 is disposed on the exit side, and when the image formation section 2 forms an image also on the backside of the sheet, the path functions as a path to switch back the sheet. Then, as necessary, a sheet such as a thick sheet which is not suitable for both sides and binding processing in a sheet bind apparatus 32 is discharged to an escape tray 34 positioned above the tray unit 33 with the discharge roller 70.

[Tray Unit]

The tray unit 33 has the collection tray 90 which collects the bunch of sheets ST bound in the sheet bind unit 80 or discharged sheets without being bound and moves up and down. In the collection tray 90, an up-and-down pinion 98 of the collection tray 90 engages in an up-and-down rack 100 constituting apart of an up-and-down rail 99 that is a shift rail to rotate, and the tray thereby moves up and down. The up-and-down pinion 98 is driven by an up-and-down motor 95 disposed in an up-and-down motor installation portion 94 below the collection tray 90 via a transmission gear 97 and the like.

[Sheet Discharge Path]

The sheet discharge path 67 is formed linearly approximately in the horizontal direction, a carry-in roller pair 72 is disposed on the entrance side to couple to a sheet carrying-out outlet of the image formation section 2, and a sheet discharge roller pair 74 is disposed on the exit side. Then, the roller pair is driven by a drive motor, not shown, to transport a sheet.

[Processing Tray]

The processing tray 76 is provided as a placement tray to place sheets to undergo binding processing, and is provided with a regulation stopper 79 that regulates a position of the rear end portion in a sheet discharge direction (direction from the right to the left in FIG. 2) of the sheet. The sheet discharged from the sheet discharge path 67 is reversely transported in a direction (rightward in FIG. 2) opposite to the discharged direction by a transport means not shown, and is introduced to the processing tray 76. Thus fed sheet is regulated at its front end by the regulation stopper 79, and the front end position is aligned.

Figure 3:
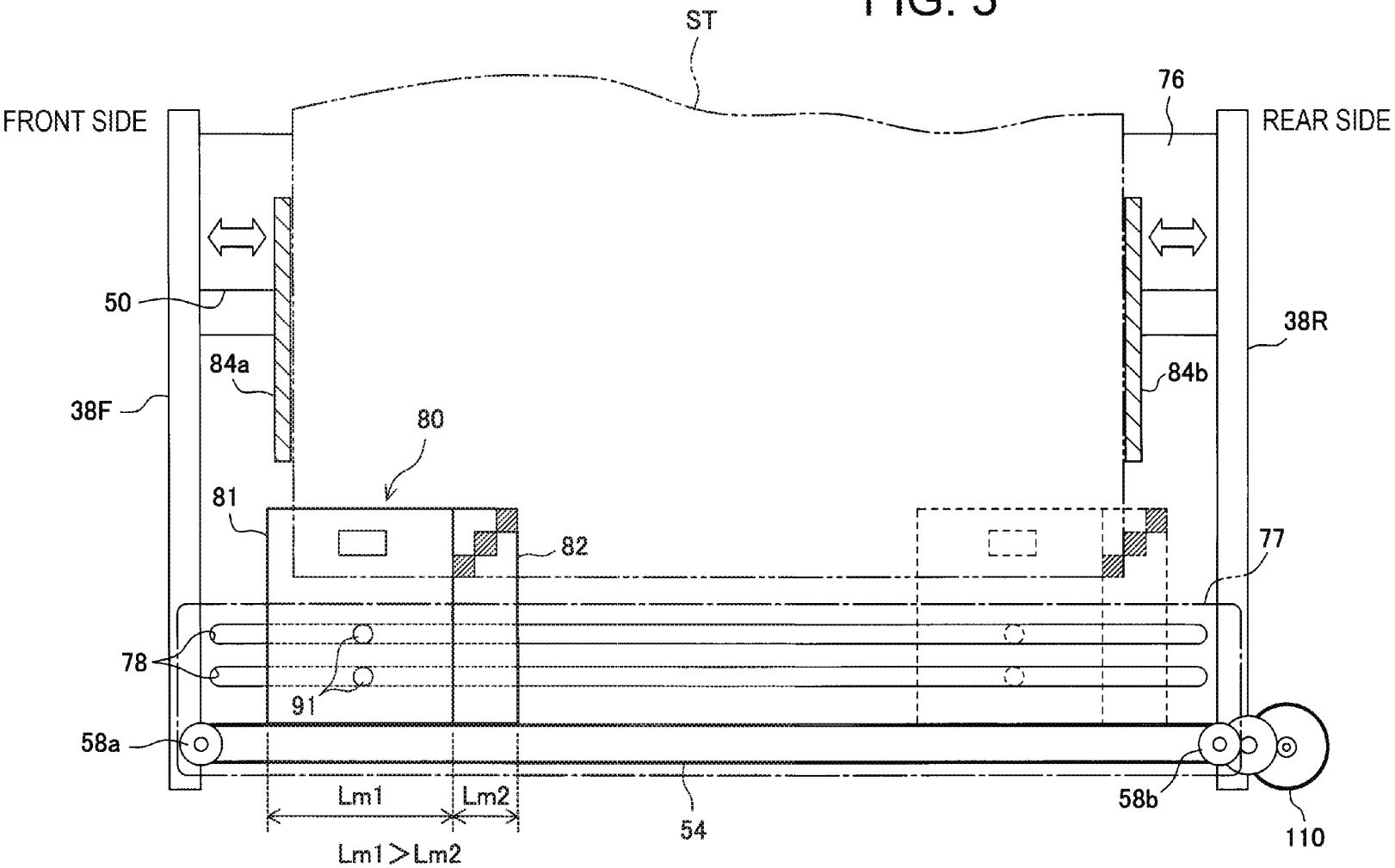
FIG. 3 is a plan view schematically illustrating an arrangement on a processing tray of a sheet bind apparatus with a needle bind unit and press bind unit integrated.

FIG. 3 shows a plan view of the processing tray 76, and the processing tray 76 is positioned in space that is partitioned and formed with a front-side frame 38F and rear-side frame 38R. The processing tray 76 is provided with an alignment apparatus 84 to position the sheet, which is introduced toward the sheet bind unit 80 from the upper direction in FIG. 2 by the reverse transport, in a direction orthogonal to the transport direction. The alignment apparatus 84 has a pair of alignment plates 84*a*, 84*b* that are respectively disposed on the front side and rear side of the processing tray 76 and that move back and forth in the direction orthogonal to the transport direction.

Each of the alignment plates 84*a*, 84*b* is provided as an alignment member for aligning the position of the sheet on the processing tray 76 in the shift direction of the sheet bind unit 80, engages in a guide groove 50 formed in the direction orthogonal to the sheet transport direction in a sheet support surface of the processing tray 76, slides in the guide groove 50, and is supported to be able to shift. It is possible to shift the alignment plates 84*a*, 84*b* individually with an alignment plate drive mechanism not shown. For example, each of the alignment plates 84*a*, 84*b* is held by a belt not shown looped between pulleys disposed on the front side and the rear side respectively, the belt is driven by a front-side alignment motor 112 or a rear-side alignment motor 113 respectively, and it is thereby possible to shift as described above.

[Sheet Bind Apparatus]

Figure 4:
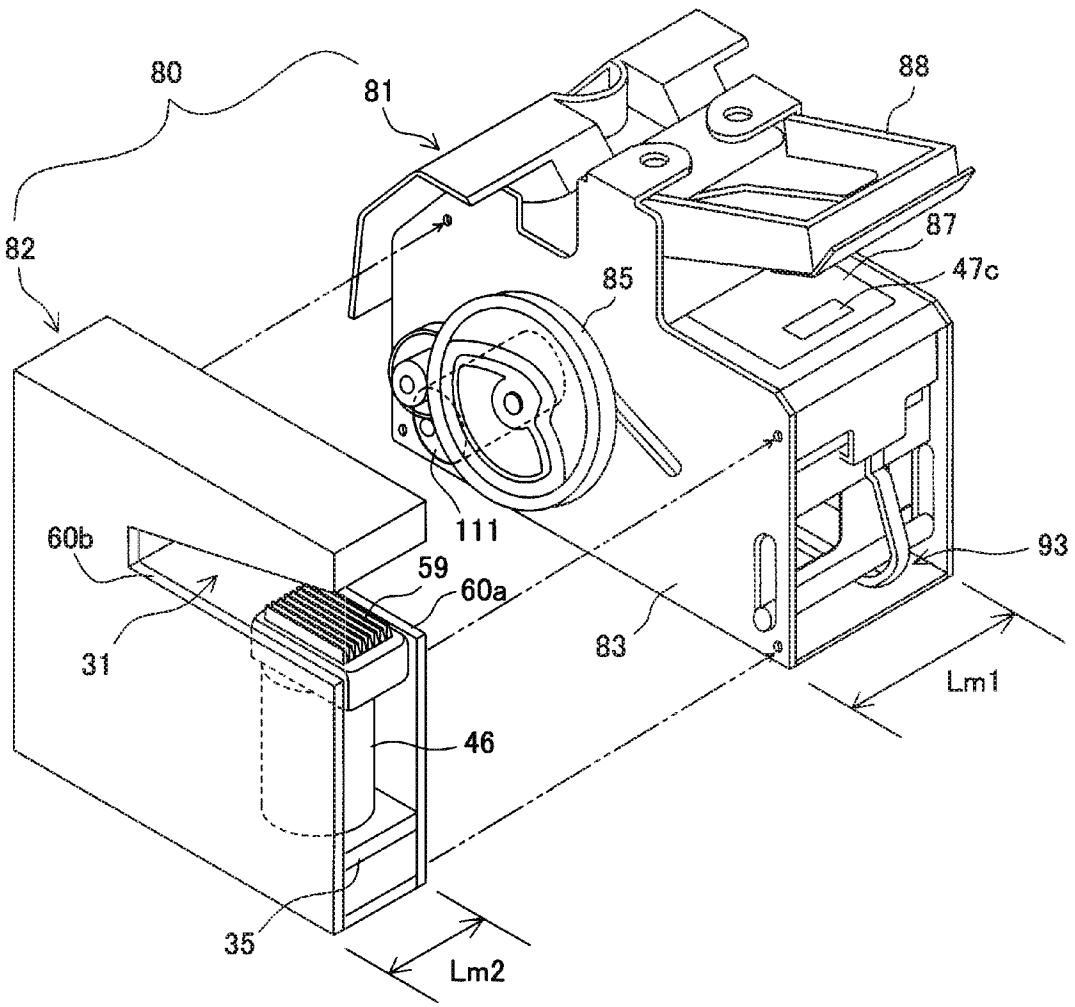
FIG. 4 is a perspective view illustrating a position relationship between the needle bind unit and the press bind unit provided together.

As shown in FIG. 4, the sheet bind unit 80 is configured integrally by arranging a needle bind unit 81 and press bind unit 82 parallel in the lateral direction. As shown in FIGS. 2 and 3, the sheet bind unit 80 is disposed on the front end side of the processing tray 76 i.e. near the end edge on the side opposite to the collection tray 90, where the front, which is the side to receive a sheet to undergo binding processing, of the needle bind unit 81 and press bind unit 82 faces the processing tray 76 side.

Below the front end-side end portion of the processing tray 76 is provided a shift bench 77 of the sheet bind unit 80 which extends over the entire width at least in the right-and-left direction (i.e. from the front side to the rear side). In the shift bench 77 is formed a pair of parallel grooves 78 extending over substantially the entire width in the right-and-left direction. The sheet bind unit 80 is installed on the shift bench 77 by respectively fitting a pair of protrusions 91 provided in its bottom portion into the grooves 78 slidably.

In the frames 38F, 38R are disposed a pair of left and right pulleys 58*a*, 58*b*, and a timing belt 54 (belt with teeth) is looped between the pulleys. To one of the pulleys 58*b* is coupled a bind unit shift motor 110. The sheet bind unit 80 is coupled to the timing belt 54, and by driving the bind unit shift motor 110, is capable of reciprocating and shifting in the right-and-left direction on the shift bench 77.

In this Embodiment, a breadth of the press bind unit 82 constituting the sheet bind unit 80 i.e. a dimension in its shift direction is set to be smaller than a breadth of the needle bind unit 81 constituting the sheet bind unit 80 similarly. In other words, in FIGS. 3 and 4, when it is assumed that the breadth of the press bind unit 82 is Lm2, and that the breadth of the needle bind unit 81 is Lm1, it is set that Lm2<Lm1. For example, when the breadth Lm1 of the needle bind unit 81 is about 60 mm, it is possible to set the breadth Lm2 of the press bind unit 82 at about 15 mm.

By this means, as the needle bind unit 81, also in adopting a general apparatus•mechanism that have conventionally been used as described later, it is possible to suppress the dimension not to be excess in the shift direction of the sheet bind unit 80 provided with the needle bind unit 81 and press bind apparatus 82 together, and to make the apparatus smaller than at least the same type of conventional sheet bind apparatus. By this means, it is possible to suppress upsizing of the sheet processing apparatus B itself, and to concurrently suppress manufacturing costs by using the conventional general needle bind unit.

[Needle Bind Unit]

As the needle bind unit 81 are used various types conventionally known as the apparatus for performing binding processing with staples. For example, in the needle bind unit 81 shown in FIG. 4, a needle bind motor 111 is stored inside a unit frame 83 forming a contour of the unit, and on the side surface of the unit frame 83 is disposed a drive cam 85 that is driven to rotate by the needle bind motor 111.

In the lower portion of the unit frame 83 is provided a drive mechanism portion 93 that drives a staple formed in the shape of a C toward a bunch of sheets ST on the processing tray 76 to be driven by the drive cam 85. On the upper surface of the unit frame 83 is formed a table 87 to place a bind portion of the bunch of sheets ST on the processing tray 76. The drive mechanism portion 93 drives a staple upward from the lower surface side of the table 87 toward the bunch of sheets ST disposed on the table 87.

In the upper portion of the unit frame 83 is provided a clincher mechanism portion 88 that bends the staple legs, which are driven by the drive mechanism portion 93 and penetrate the top surface side of the bunch of sheets ST on the table 87, along the top surface of the bunch of sheets ST. In the clincher mechanism portion 88, a rear end portion is pivotally fitted into the unit frame 83, and the bunch of sheets ST disposed on the table 87 is nipped between the top surface of the table 87 and the clincher mechanism portion 88.

Further, in the clincher mechanism portion 88 is formed a cutter unit (not shown) that cuts front end portions of the staple legs which penetrate the bunch of sheets ST and protrude upward. By the cutter unit, the front end portions of the staple legs are cut to make lengths protruding from the bunch of sheets certain, and subsequently, the clincher mechanism portion 88 bends the staple legs along the top surface of the bunch of sheets ST to perform staple binding.

Between the table 87 and the clincher mechanism portion 88 is defined an opening portion of sufficient dimensions to place the number of sheets capable of undergoing needle binding with the needle bind unit 81. Accordingly, it is possible to shift the needle bind unit 81 smoothly in the right-and-left direction in a state in which a bunch of sheets ST to undergo binding processing or subjected to binding processing is placed on the table 87, without the bunch of sheets ST being caught or damaged.

[Press Bind Unit]

The press bind unit 82 performs press binding for pressing a bunch of sheets ST from both the frontside and the backside between press teeth each having a concavo-convex surface and thereby deforming to bind. Therefore, the press bind unit 82 is provided with a press bind mechanism which presses and deforms a bind portion of the bunch of sheets ST to bind, and a press drive mechanism which drives the press bind mechanism to perform press binding.

Figure 5A:
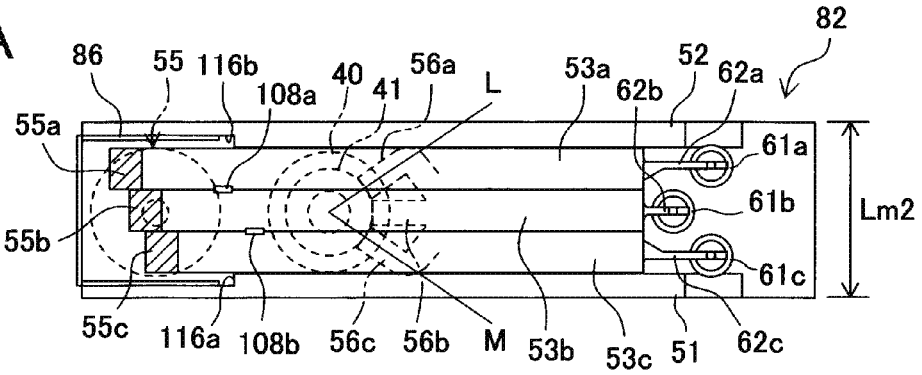
FIG. 5A is a plan view schematically illustrating a configuration of the press bind unit.
Figure 5B:
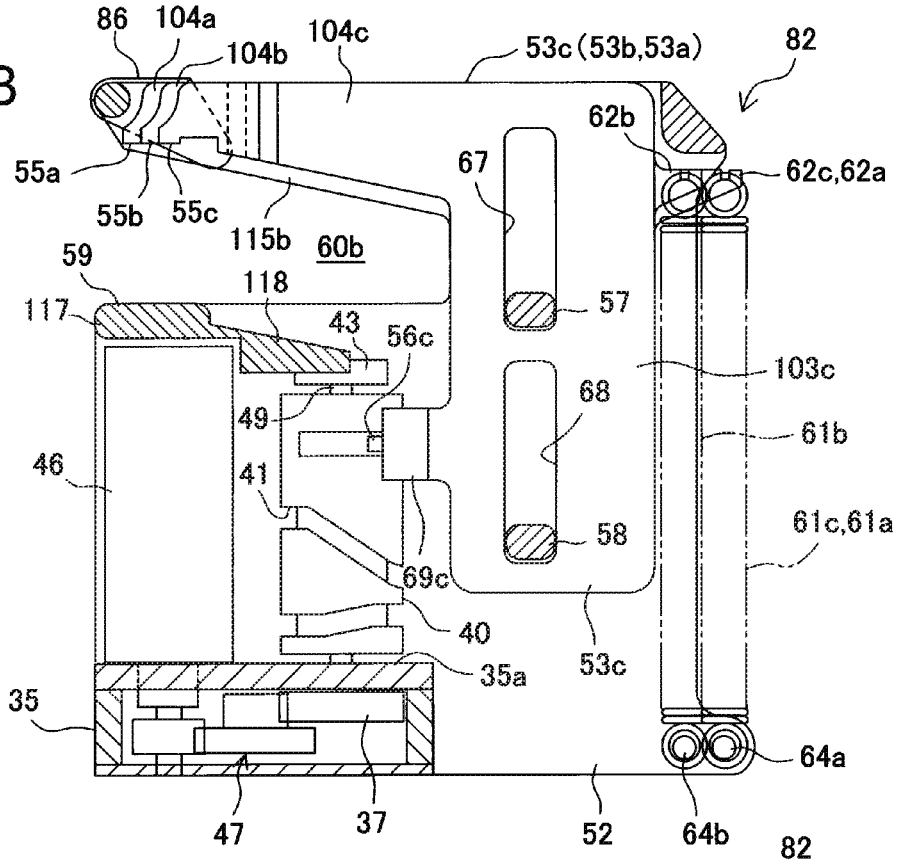
FIG. 5B is a partial sectional side elevational view.
Figure 5C:
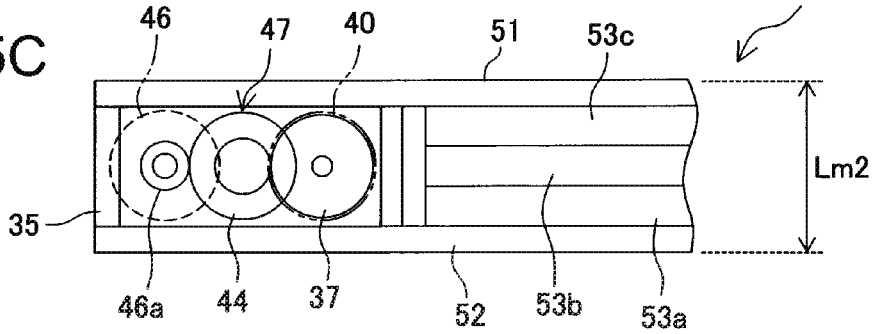
FIG. 5C is a bottom view.

FIGS. 5A to 5C schematically illustrate the entire configuration of the press bind unit 82. The press bind mechanism of the press bind unit 82 is comprised of a front plate 51, a base plate 52, three pressing plates 53*a*, 53*b*, 53*c*, and press teeth comprised of pressing teeth 55*a*, 55*b*, 55*c* and receiving tooth 59. The press drive mechanism is comprised of a press bind motor 46, pressing springs 61*a*, 61*b*, 61*c*, a cam mechanism that drives the pressing plates, and a gear mechanism that connects between the press bind motor and the cam mechanism so as to enable a drive force to be transferred.

[Press Bind Mechanism]

As shown in FIG. 5A, three pressing plates 53*a* to 53*c* each of which is a plate member are overlapped mutually in the width direction of the press bind unit 82, the front plate 51 and base plate 52 are further overlapped to sandwich the plates from the opposite sides, and the plates are mounted. The pressing plates 53*a* to 53*c* are provided to be able to slide and shift in an in-plane direction mutually and between the front plate 51 and the base plate 52, particularly, in the in-plane vertical perpendicular direction. In this Embodiment, a thickness of each of the pressing plates 53*a* to 53*c*, front plate 51 and base plate 52 is set at the order, at most, of several millimeters, and preferably about 3 mm, and it is thereby possible to make the width dimension Lm2 of the entire press bind unit 82 significantly shorter than the conventional same type of needleless bind apparatus.

Figure 8:
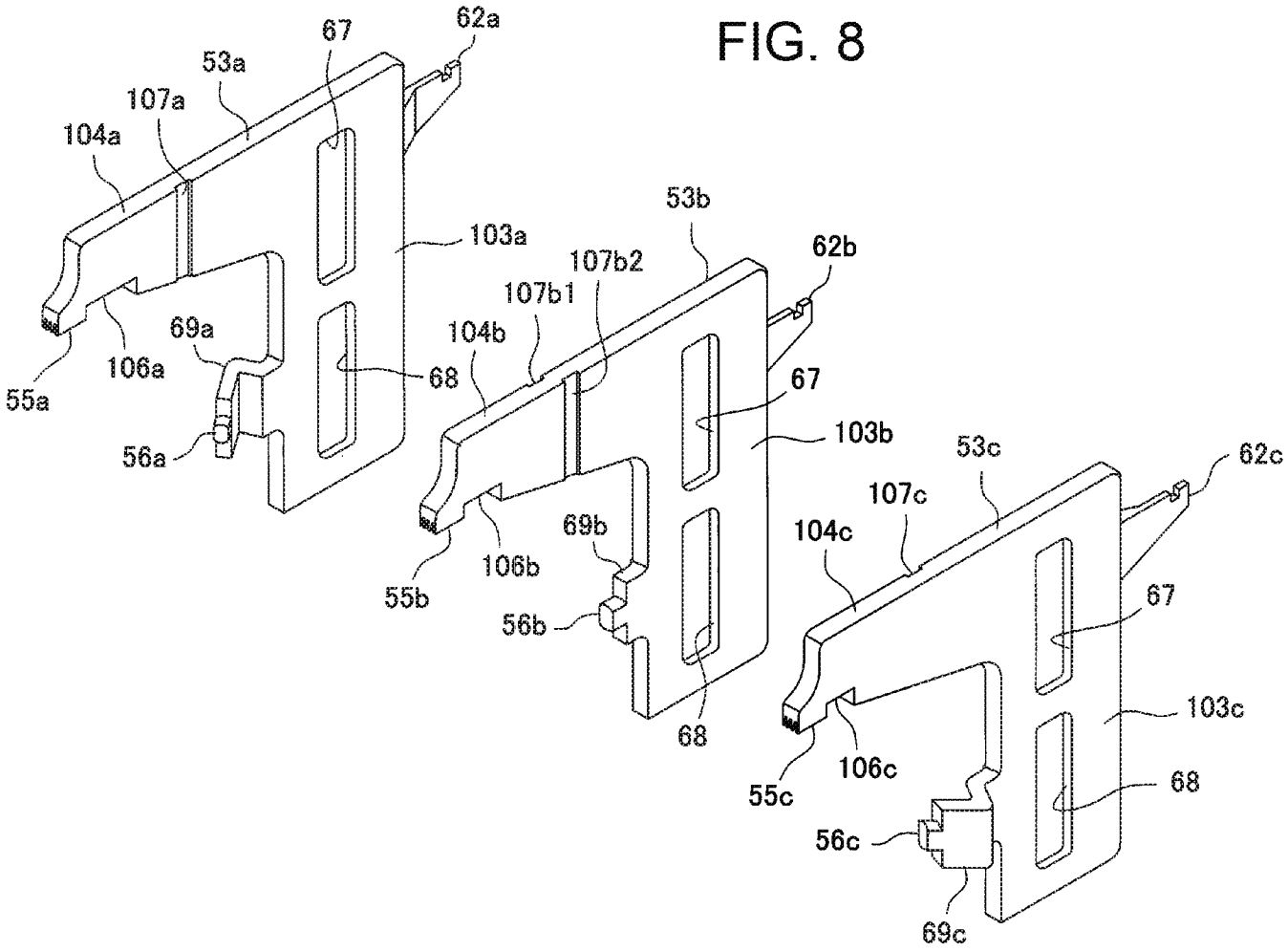
FIG. 8 is an exploded perspective view of pressing plates respectively on the rear side, center and front side disposed between a front plate and the base plate.

As shown in FIG. 8, each of the pressing plates 53*a* to 53*c* is formed of a relatively thin plate-shaped member forming the shape of an inverse L. Both the frontside and the backside of each of the pressing plates 53*a* to 53*c* are formed with smoothness so as to enable opposite surfaces of the other adjacent plate, front plate 51 or base plate 52 to slide. The pressing plates have movable base portions 103*a* to 103*c* each forming a substantially vertically long rectangle on the right side in the figure, and pressing arm portions 104*a* to 104*c* that extend from the upper portion of the base portion to the left side in the figure i.e. to the front side of the press bind unit 82, respectively.

In each of the movable base portions 103*a* to 103*c*, a pair of guide slots 67, 68 each extending in the vertical direction in the figure is provided to penetrate in the same line in the vertical direction. Follower pins 56*a* to 56*c* are provided at front ends of pin support portions 69*a* to 69*c* to protrude via the portions 69*a* to 69*c*, in the side on the pressing arm portion side of the movable base portions 103*a* to 103*c*, respectively. In the side on the side opposite to the pressing arm portions 104*a* to 104*c* of the movable base portions 103*a* to 103*c*, spring fastening portions 62*a* to 62*c* to fasten upper ends of the pressing springs are provided to protrude in the direction opposite to the pressing arm portions near the upper ends, respectively.

FIG. 5B illustrates a state in which upper sides of the movable base portions 103*a* to 103*c* and sides on the pressing arm portions 104*a* to 104*c* side are aligned, and the pressing plates 53*a* to 53*c* are installed in the base plate 52. As shown in FIG. 5B, in the movable base portions 103*a* to 103*c*, respective lengths in the vertical direction i.e. heights, and lengths in the right-and-left direction i.e. widths except the spring fastening portions 62*a* to 62*c* in the figure are the same. The spring fastening portions 62*a*, 62*c* of the pressing plates 53*a*, 53*c* on the front side and rear side have the same width, and in contrast thereto, the spring fastening portion 62*b* of the center pressing plate 53*b* is formed to be slightly shorter than the portions 62*a*, 62*c*. Therefore, the center spring fastening portion 62*b* is displaced and disposed in a dented position on the pressing arm portion side from the other spring fastening portions 62*a*, 62*c*.

Further, the guide slots 67, 68 respectively of the movable base portions 103*a* to 103*c* are formed in the same length and same certain width, and are disposed to mutually overlap completely in the installation state of FIG. 5B. Further, the cam follower pins 56*a* to 56*c* are formed in the same shape and dimension in cross section, and are disposed to be the same heights as one another in the installation state of FIG. 5B.

As shown in FIGS. 5B and 8, in the pressing arm portions 104*a* to 104*c*, pressing teeth 55*a* to 55*c* are formed integrally in lower edges of respective front end portions. Further, in the lower edges of the pressing arm portions 104*a* to 104*c*, as shown in FIG. 8, concave portions 106*a* to 106*c* with a predetermined length are formed on the movable base portion side immediately near the pressing teeth 55*a* to 55*c*, as clearances so as not to contact a portion of a bunch of sheets ST in the periphery thereof in pressing a bind portion of the bunch of sheets ST with the pressing teeth.

Further, in the pressing arm portions 104*a* to 104*c*, thin grooves 107*a*, 107*b*1, 107*b*2 and 107*c* crossing the pressing arm portions vertically in concave shapes are provided in surfaces opposed to adjacent other pressing arm portions 104*a* to 104*c*. The thin grooves 107*a* and 107*b*1, and 107*b*2 and 107*c* of opposed surfaces are mutually aligned in the longitudinal direction of the pressing arm portions, and are disposed to each define a single thin vertical through hole 108*a* or 108*b* in the installation state of FIG. 5A, respectively.

The adjacent pressing plates 53*a* to 53*c* shift relatively in a state in which opposed surfaces are in slide-contact with one another, and therefore, it is preferable that the opposed surfaces are beforehand coated with a lubricant such as, for example, grease. At this point, when the lubricant reaches the front ends of the pressing arm portions 104*a* to 104*c* through the opposed surfaces, there is the risk that the lubricant adheres to sheets to undergo binding processing and soils. The vertical through holes 108*am*, 108*b* in this Embodiment prevent the lubricant from going ahead thereof and reaching the front ends of the pressing arm portions 104*a* to 104*c*, as an oil thrower.

As shown in FIG. 5B, the pressing arm portions 104*a* to 104*c* are formed so that their lengths in the extension direction are gradually longer on the back side than on the front side in the figure, i.e. on the rear side than on the front side. By this means, as shown in FIG. 5A, the pressing teeth 55*a* to 55*c* in the front ends of the pressing arm portions are provided so that the position shifts in the extension direction, while slightly overlapping. On the other hand, other portions of the pressing arm portions 104*a* to 104*c* including the concave portions 106*a* to 106*c* are provided to overlap in the installation state of FIG. 5B.

Figure 9:
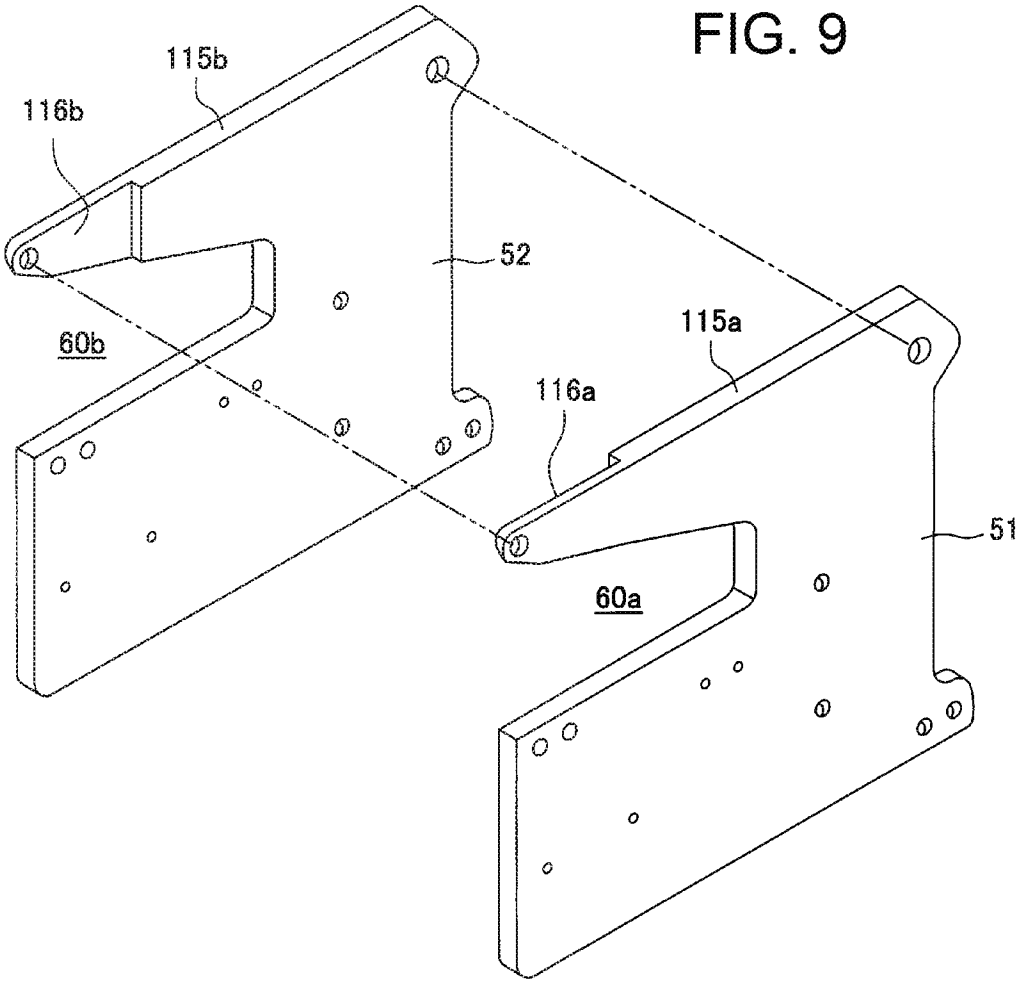
FIG. 9 is a perspective view illustrating a position relationship between the front plate and the base plate.

As shown in FIG. 9, the front plate 51 and base plate 52 are formed of a pair of substantially flat plate members mutually forming plane symmetry in the installation state of FIG. 5A. At the tops of the front plate 51 and base plate 52 are formed fixed arm portions 115*a*, 115*b* extending to the front side of the press bind unit 82. As shown in FIG. 5B, the fixed arm portions 115*a*, 115*b* are provided substantially in the same shape as the pressing arm portions 104*a* to 104*c*, while being slightly larger than the portions 104*a* to 104 so as to cover the pressing arm portions.

Figure 10:
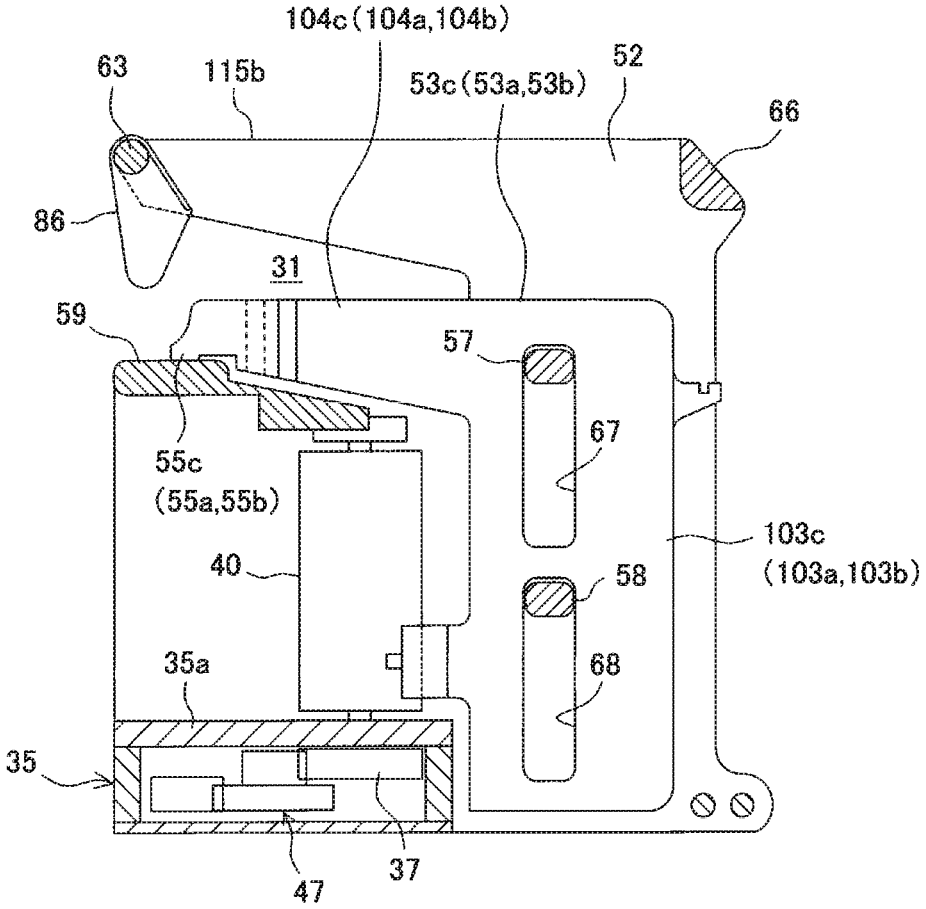
FIG. 10 is an explanatory view of a press position in which a pressing tooth is pressed against a receiving tooth.

Below the fixed arm portions 115*a*, 115*b* of the front plate 51 and base plate 52 are formed notches 60*a*, 60*b* with the same shape in the form of a wedge largely opened to the front side of the press bind unit 82. The lower sides of the notches 60*a*, 60*b* are formed in the shape of a straight line approximately parallel with a sheet placement surface of the processing tray 76 when the front of the press bind unit 82 is disposed on the tray 76 side. Accordingly, by the notches 60*a*, 60*b*, as shown in FIGS. 4 and 10, a placement portion 31 is defined which is space to place a bind portion of a bunch of sheets ST to undergo press binding.

An opening height i.e. dimension in the vertical direction of the notches 60*a*, 60*b* is set to be larger than at least a thickness of the number of a bunch of sheets ST capable of undergoing needle binding with the needle binding unit 81, and is preferably set to provide sufficient allowance with respect to the thickness, in a range in which at least the bunch of sheets ST to undergo binding processing is placed or passes. A depth of the notches 60*a*, 60*b* is set at a dimension enough to place or pass a side portion of a bunch of sheets ST to undergo binding processing. For example, it is possible to set the notches 60*a*, 60*b* at substantially the same dimensions as those of the opening portion defined between the table 87 and the clincher mechanism portion 88 of the needle bind unit 81.

Figure 7:
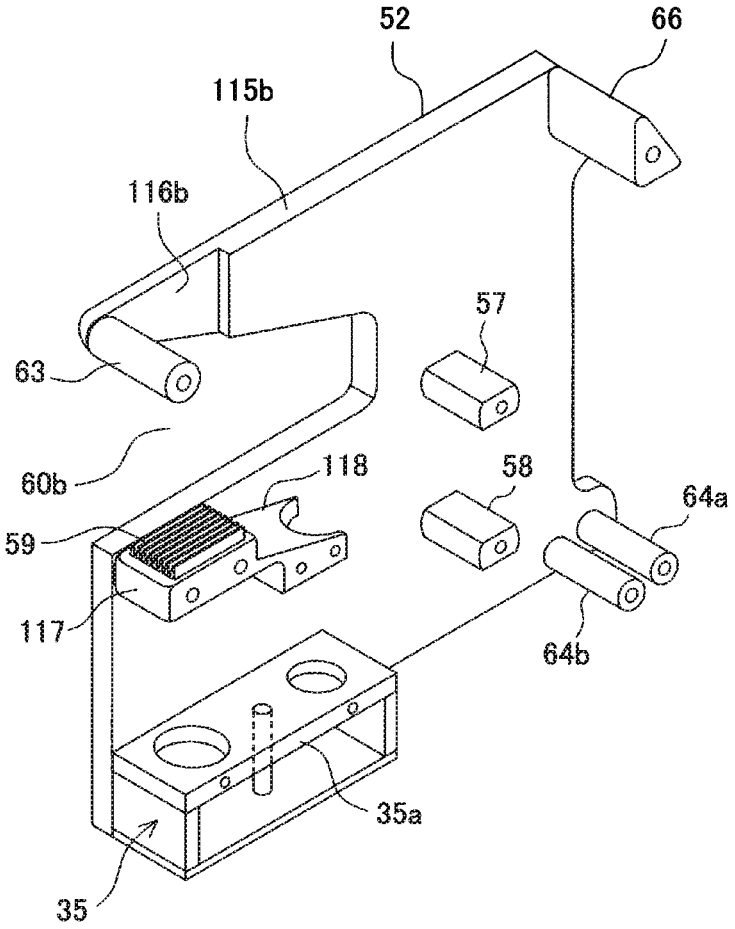
FIG. 7 is a perspective view of a base plate without the drive system.

In the base plate 52, as shown in FIG. 7, in the surface opposed to the front plate 51, a joint pin 63 is provided at the front end of the fixed arm portion 115*b*, two joint pins 64*a*, 64*b* are provided in a position diagonally opposite thereto at the lower end on the right side in the figure, and a joint rod 66 is provided at the upper end on the right side in the figure above the pins so that each of the pins and rod protrudes in the same height. The front plate 51 is positioned in front ends of the joint pin 63, joint pins 64*a*, 64*b* and joint rod 66 and is integrally fixed with appropriate fasteners such as bolts, and a certain gap is thereby defined to install the pressing plates 53*a* to 53*c* in between the plate 51 and the base plate 52.

Further, two upper and lower guide pins 57, 58 are provided to protrude in the surface opposed to the front plate 51 of the base plate 52. The pressing plates 53*a* to 53*c* are installed in the base plate 52 in order of the rear side, center and front side, by fitting the guide slots 67, 68 into the guide pins 57, 58, respectively. The guide pins 57, 58 are provided to fit slidably only in the longitudinal direction, substantially without play in its width direction. By this means, the pressing plates 53*a* to 53*c* are held in the gap between the base plate 52 and the front plate 51 to be slidable only in the in-phase vertical direction.

Further, on the lower-side side near the opening end of the notch 60*b*, a fix support portion 117 of the receiving tooth 59 is integrally bonded to the base plate 52. On the top surface of the fix support portion 117, the receiving tooth 59 is integrally provided in an appropriate shape in a tooth formation region of a plane rectangle with the direction of the lower side as long sides. The receiving tooth 59 is disposed so as to face the pressing teeth 55*a* to 55*c* at the front ends of the pressing arm portions 104*a* to 104*c* disposed above.

In the fix support portion 117, a bearing support portion 118 of the cam mechanism is integrally formed so as to extend obliquely downward from the end portion on the side opposite to the opening end of the notch 60*b*, and is similarly integrally bonded to the base plate 52. Further, below the fix support portion 117, a press bind drive portion base 35 to attach the press drive mechanism except the pressing spring is integrally bonded along the lower side of the base plate 52.

The guide pins 57, 58, fix support portion 117, bearing support portion 118 and press bind drive portion base 35 have the same height as that of the joint pin 63, joint pins 64*a*, 64*b* and joint rod 66. In attaching to the base plate 52, the front plate 51 is integrally fixed to the guide pins 57, 58, fix support portion 117, bearing support portion 118, press bind drive portion base 35, joint pins 63, 64*a*, 64*b* and joint rod 66 with appropriate fasteners such as bolts. Thus, the entire press drive mechanism including the pressing spring as described later is stored in the gap between the front plate 51 and the base plate 52.

In the receiving tooth 59, with the direction orthogonal to the lower side being as an alignment direction of the tooth, a plurality of upward projections in the shape of ribs extending in the lower side direction, and concave grooves in the shape adapted thereto are formed alternately. The receiving tooth 59 is comprised of linear projections and concave grooves in this Embodiment, and is capable of adopting various concavo-convex shapes. Further, the alignment direction of the tooth is not limited to the direction orthogonal to the lower side direction.

As described later, the pressing teeth 55*a* to 55*c* that sequentially mesh with the receiving tooth 59 constitute the pressing tooth that corresponds to the receiving tooth 59, with three teeth continuous from the front side to the rear side as a single member. Each of the pressing teeth 55*a* to 55*c* is provided in an appropriate shape integrally in a tooth formation region of a plane rectangle smaller than the tooth formation region of the receiving tooth 59, with the extension direction of the pressing arm portion as the long side, in the lower surfaces of the front end portions of the pressing arm portions 104*a* to 104*c*.

In the pressing teeth 55*a* to 55*c*, with the thickness direction of the pressing arm portions 104*a* to 104*c* as an alignment direction of teeth respectively, a plurality of downward projections in the shape of ribs extending in the direction orthogonal to the alignment direction, and concave grooves in the shape adapted thereto are formed alternately. The downward projections and concave grooves of the pressing teeth 55*a* to 55*c* have the shape and dimensions capable of meshing with the upward projections and concave grooves of the receiving tooth 59.

In this Embodiment, in each of the pressing teeth 55*a* to 55*c*, the dimension in the alignment direction of the tooth is set at approximately ⅓ the dimension in the alignment direction of the tooth of the receiving tooth 59. When it is considered that the tooth formation region of the receiving tooth 59 is divided into three in the alignment direction of teeth, the pressing teeth 55*a* to 55*c* respectively correspond to receiving tooth portions on the front side, center and rear side. Accordingly, when the pressing plates 53*a* to 53*c* are moved down along the guide slots 67, 68 that respectively engage in the guide pins 57, 58, the pressing teeth 55*a* to 55*c* on the front side, center and rear side mesh with the receiving tooth 59 in respective corresponding receiving tooth portions.

Further, as described above, the pressing teeth 55*a* to 55*c* are disposed, while partially overlapping and shifting the position from the front side to the rear side in the extension direction of the pressing arm portions 104*a* to 104*c*. Accordingly, the pressing teeth 55*a* to 55*c* mesh with the receiving tooth 59 in a straight line in the diagonal direction for connecting a corner portion on the notch back side on the front side of the top surface of the receiving tooth 59 and a corner portion on the notch opening side on the rear side of the top surface. As a result, press traces in the shape of steps inclined in the diagonal direction are formed in a bind portion of a bunch of sheets ST subjected to press binding with the press bind unit 82.

In another Embodiment, it is possible to form press traces by the receiving tooth 59 and the pressing teeth 55*a* to 55*c* in the shape of steps inclined along another diagonal direction on the top surface of the receiving tooth 59, in a checkered pattern where the position in the long side direction on the top surface of the receiving tooth 59 is alternately changed between the front side and the rear side, or linearly in the arrangement direction of the tooth of the receiving tooth 59. For example, it is possible to form these traces by changing lengths in the extension direction of the pressing arm portions 104*a* to 104*c*, or changing the position in the extension direction of the pressing arm portion of each of the pressing teeth 55*a* to 55*c*.

Further, by arranging the pressing teeth 55*a* to 55*c* discontinuously mutually in the alignment direction of the tooth and in the extension direction of the projection, it is possible to form three discontinuous press traces between the receiving tooth 59 and the teeth 55*a* to 55*c*. For example, it is possible to form the traces, by making the dimension in the alignment direction of the tooth of the pressing teeth 55*a* to 55*c* smaller than the plate thickness of the pressing plates 53*a* to 53*c*, and/or setting positions in the extension direction of the pressing arm portions of the pressing teeth 55*a* to 55*c* not to overlap one another.

Furthermore, the tooth formation region of each of the pressing teeth 55*a* to 55*c* is not limited to the same dimension. For example, it is possible to set the pressing teeth 55*a* to 55*c* so that three plane dimensions of respective tooth formation regions mutually differ from one another, or only one of the dimensions differs from the others.

Still furthermore, the number of the pressing plates 53*a* to 53*c* is not limited to three, and may be two, or four or more. Moreover, it is also possible to provide a single pressing plate with two or more pressing teeth. In this case, it is possible to arrange a plurality of pressing teeth separately along the lower side of a single pressing plate and/or in the thickness direction of the lower side of the pressing plate.

As a matter of course, with respect to the projections and concave grooves of the receiving tooth 59 and pressing teeth 55*a* to 55*c*, it is possible to form various forms different from those in the above-mentioned Embodiments. For example, it is also possible to form the projections in the shape of slating linear ribs with respect to the alignment direction of the tooth, the shape of a V bent at some midpoint, or curved waveform.

Figure 6B:
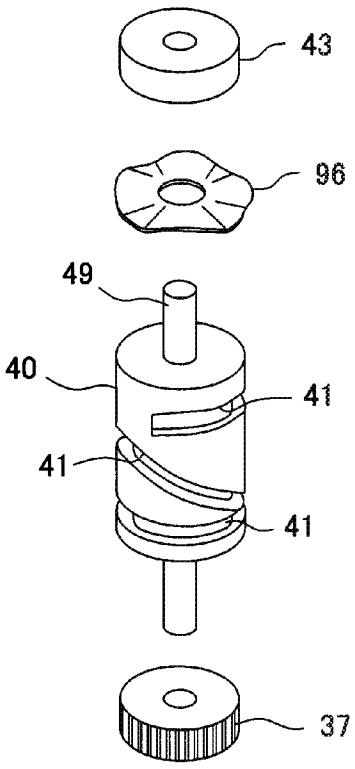
FIG. 6B is an exploded perspective view illustrating a cylindrical cam and components related thereto.
Figure 6A:
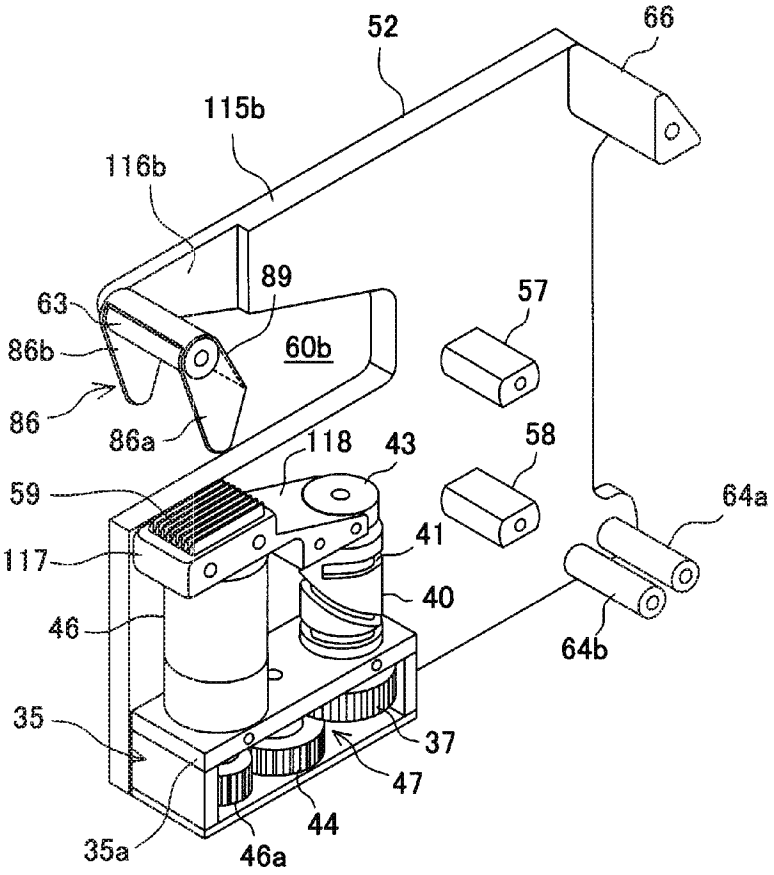
FIG. 6A is a perspective view illustrating a drive system of the press bind unit.

As shown in FIG. 6A, at the front end of the fixed arm portion 115*b* of the base plate 52, a sheet guide 86 is provided swingably by the joint pin 63. The sheet guide 86 is provided to partially limit an opening height of the notch from above so as to guide a bunch of sheets ST, which undergoes press binding with the press bind unit 82, to the placement portion 31 inside the notches 60*a*, 60*b* smoothly, without fluttering the front end portion of the bunch of sheets ST vertically.

The sheet guide 86 has a pair of guide pieces 86*a*, 86*b* with the same shape and dimensions which are disposed parallel and symmetrically at a predetermined separation distance, and an engagement plate portion 89 that joins the pieces. Each of the guide pieces 86*a*, 86*b* is made of a thin plate forming an approximately isosceles triangle where the vertex is relatively large. The engagement plate portion 89 is made of a thin plate that connects one of equilateral portions of the isosceles triangle continuously from near the vertex portion to near the base angle portion, and is formed integrally with both the guide pieces.

The sheet guide 86 is pivotally fitted into the joint pin 63 in the base angle portion on the side where the engagement plate portion 89 is provided, with the base of the isosceles triangle being on the opening side of the notch 60*b*. The sheet guide 86 is attached with the base of the isosceles triangle inclined obliquely downward to the back side of the notch in a state of naturally hanging from the joint pin 63 under its own weight. By this means, even when the front end portion of the sheet entering inside the notch comes into contact with the sheet guide 86, the sheet is guided downward toward the placement portion 31, without being caught or damaged.

The sheet guide 86 is provided so as to vary its swing state and swing position in conjunction with vertical operation of the pressing plates 53*a* to 53*c* guided by the guide slots 67, 68 and guide pins 57, 58. FIG. 5B illustrates a state in which the pressing plates 53*a* to 53*c* wait in a top dead center position, FIG. 10 illustrates a state in which the plates perform press binding on a bunch of sheets (not shown) in a bottom dead center position, and FIG. 11 illustrates a state in which the plates wait in a sheet receiving position below the top dead center position.

Figure 18A:
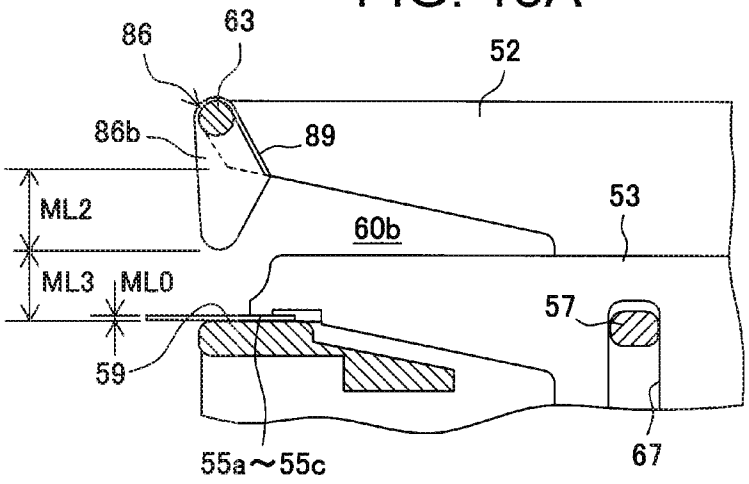
FIG. 18A is a cross-sectional explanatory view where the pressing tooth is in a press position for crimping a bunch of sheets.

As shown in FIGS. 10 and 18A, in a press bind position where the pressing teeth 55*a* to 55*c* mesh with the receiving tooth 59 in the bottom dead center position of the pressing plates 53*a* to 53*c*, the sheet guide 86 is in the state of naturally hanging swingably, and its low end is spaced apart from the upper edge of the pressing plates 53*a* to 53*c*, and the height is positioned in approximately the same height.

Figure 17A:
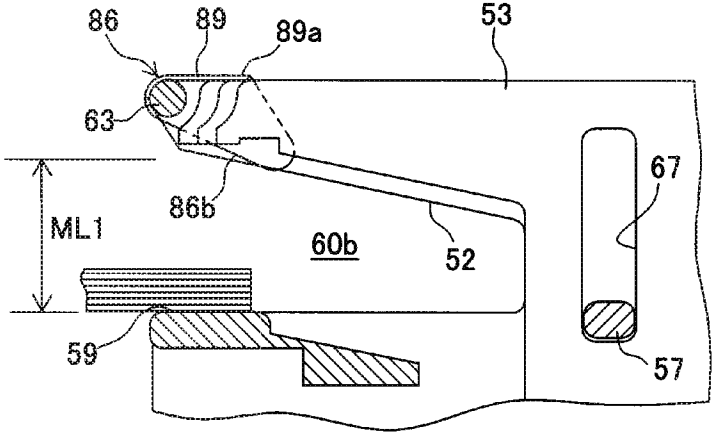
FIG. 17A is a cross-sectional explanatory view where the pressing tooth and sheet guide are in retract positions separated farthest from the receiving tooth.
Figure 17B:
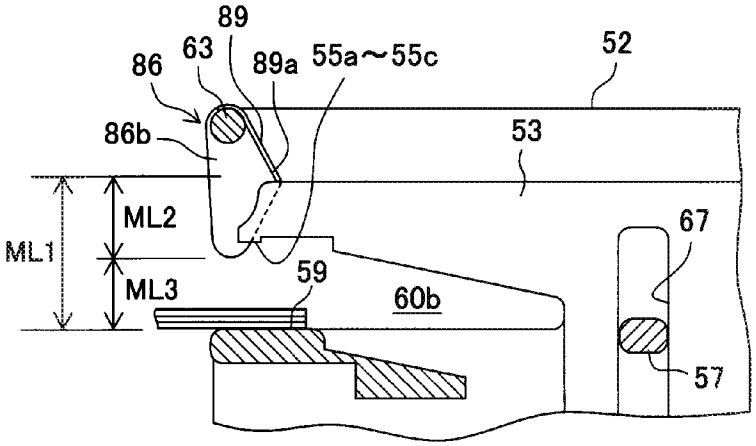
FIG. 17B is a cross-sectional explanatory view where the pressing tooth and sheet guide are in receiving positions for receiving sheets.
Figure 17C:
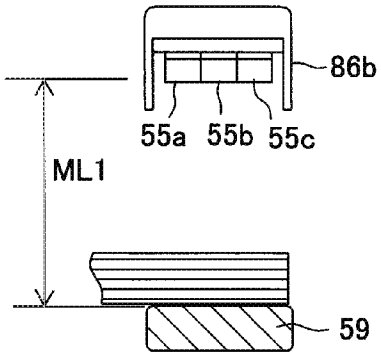
FIG. 17C is a front explanatory view of FIG. 17A.
Figure 17D:
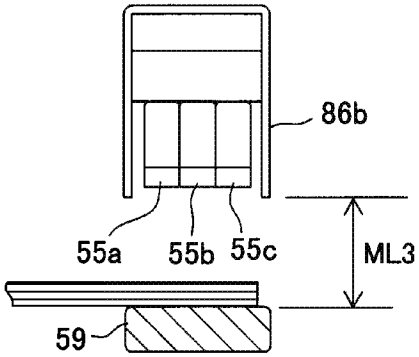
FIG. 17D is a front explanatory view of FIG. 17B.

The number of sheets on which the needle bind unit 81 is capable of performing needle binding at a time is about several tens, and in contrast thereto, the number of sheets on which the press bind unit 82 is capable of performing press binding at a time is about several. Accordingly, as shown in FIGS. 17A and 17B, when it is assumed that the opening height of the notches 60*a*, 60*b* is ML1, the opening height of the notches limited by the sheet guide 86 is ML2, and that the opening height of the notches at this point is ML3, ML3 is set at a dimension that enables the number of sheets undergoing press binding to be carried in the placement portion 31 smoothly. Accordingly, ML2 is set at a size capable of reserving ML3 with respect to ML1.

Figure 11:
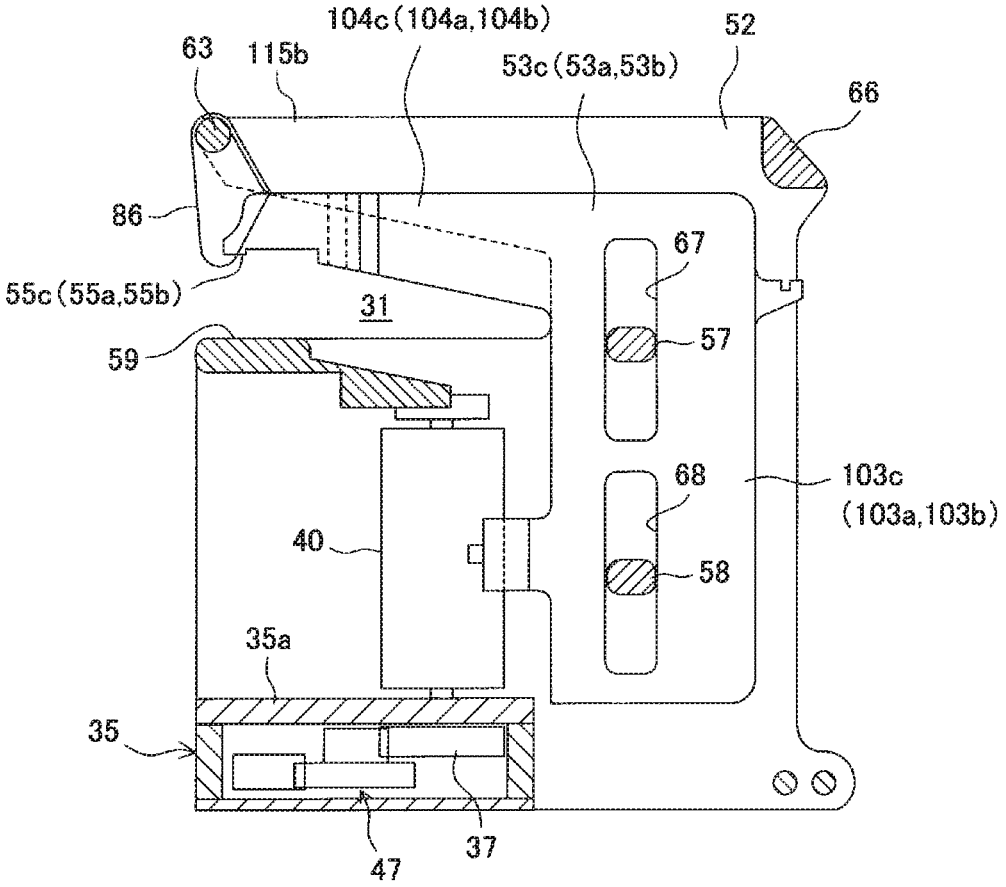
FIG. 11 is an explanatory view of a sheet receiving position in which the pressing tooth separates upward from the receiving tooth.

As shown in FIGS. 11 and 17B, when the pressing plates 53 (53*a* to 53*c*) are in the sheet receiving position, the sheet guide 86 is in the state of naturally hanging swingably, and the pressing plates 53*a* to 53 are in a position of not protruding downward from the low end of the sheet guide 86 where front end portions of respective pressing arm portions 104*a* to 104*c*, particularly the pressing teeth 55*a* to 55*c* are stored in between the guide pieces 86*a*, 86*b*. Accordingly, the sheet to undergo press binding is guided smoothly to the placement portion 31, without its front end being caught in the pressing teeth 55*a* to 55*c*.

In this Embodiment, in the sheet receiving position, the pressing plates 53*a* to 53*c* are disposed so that upper edges of front end portions of the pressing arm portions 104*a* to 104*c* come into contact with a rear end 89*a* of the engagement plate portion 89 of the sheet guide 86. Accordingly, when the pressing plates 53*a* to 53*b* shift toward the top dead center position from this position, the sheet guide 86 rotates upward in conjunction with the ascent of the pressing plates 53*a* to 53*c*.

Figure 16A:
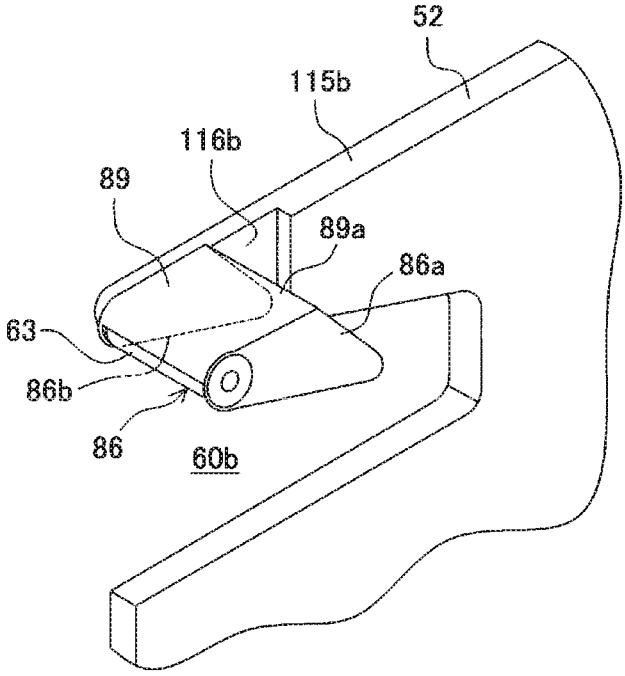
FIG. 16A is a perspective view illustrating an attachment state of a sheet guide.

As shown in FIGS. 5A and 16A, in the front end portions of the fixed arm portions 115*a*, 115*b*, in their inner surfaces are formed shallow concave portions 116*a*, 116*b* that correspond to the guide pieces 86*a*, 86*b* of the sheet guide 86. When the pressing plates 53*a* to 53*c* arrive at the top dead center position, the guide pieces 86*a*, 86*b* of the sheet guide 86 are stored in the concave portions 116*a*, 116*b*.

Figure 16B:
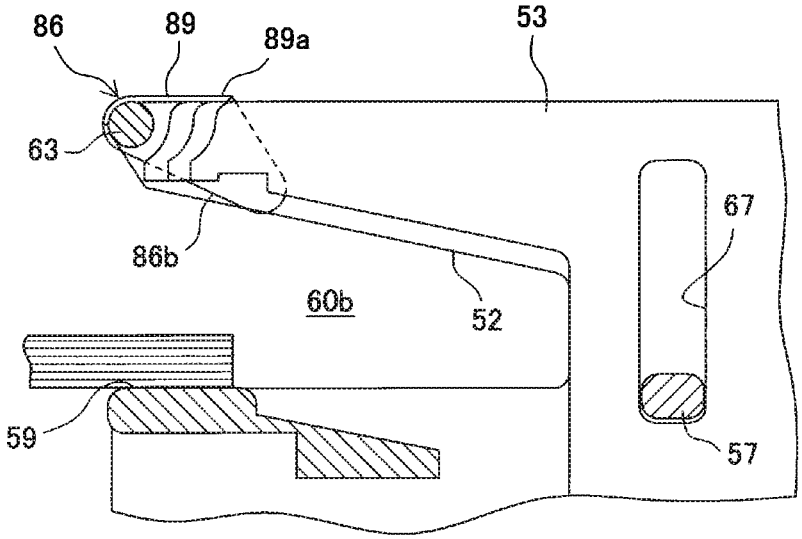
FIG. 16B is an explanatory view illustrating a position relationship between the sheet guide and the pressing plates.

As shown in FIGS. 5B, 16B and 17A, looking from the side surface, the sheet guide 86 overlaps the fixed arm portion 115*b* (115*a*) of the base plate 52 (and front plate 51) to hide, and is held not to protrude to the inside of the notches 60*a*, 60*b* from the lower side of the fixed arm portion. Accordingly, since the opening height of the notches 60*a*, 60*b* is maximum (ML1), as shown in FIG. 17A, in a state in which a bunch of sheets ST undergoing needle binding is placed in the placement portion 31, it is possible to shift the needleless bind unit 82 smoothly to the rear side or the front side on the shift bench 77 shown in FIG. 3 together with the needle bind unit 81, without the bunch of sheets ST being caught in inner peripheries of the notches 60*a*, 60*b*.

[Press Drive Mechanism]

As shown in FIG. 5, the press bind drive portion base 35 is formed in the shape of a rectangular box with a pair of upper and lower plates and a pair of side plates. On the top surface of the upper plate 35*a*, the press bind motor 46 is fixed perpendicularly on the notch opening side with its output shaft protruding inside the press bind drive portion base 35. On the notch back side on the top surface of the upper plate 35*a*, a circular cam 40 is inserted rotatably perpendicularly parallel with the press bind motor 46.

As shown in FIG. 6B, the cylindrical cam 40 has a rotating shaft 49 integrally formed in the same axis. A bearing 43 is mounted on the upper end of the rotating shaft 49, and a spring washer 96 made of a wave washer is interposed between the bearing and the top surface of the circular cam 40. The bearing 43 is fixed to a bearing support portion 18, and supports the upper end side of the cylindrical cam 40 rotatably. The lower portion of the rotating shaft 49 is supported by the upper plate 35*a* rotatably, with its lower end protruding inside the press bind drive portion base 35. At this point, the lower surface of the cylindrical cam 40 directly slides on the top surface of the upper plate 35*a* or is supported via an appropriate bearing.

In the press bind drive portion base 35 is stored a deceleration gear line 47 comprised of a drive gear 46*a* installed in the front end of the output shaft of the press bind motor 46, a driven gear 37 installed in the lower end of the rotating shaft 49 of the cylindrical cam 40, and an intermediate gear 44 that meshes with the gears 46*a* and 37. The rotation force of the press bind motor 46 is decelerated by the deceleration gear line 47, and is transferred to the cylindrical cam 40.

A cam groove 41 is provided in a concave shape in the outer surface of the cylindrical cam 40. The cam groove 41 turns to substantially make two loops in a counterclockwise spiral shape. In the cam groove 41 are engaged the cam follower pints 56*a* to 56*c* of the pressing plates 53*a* to 53*c* successively in the rotation direction of the cylindrical cam 40. Therefore, the follower pin support portions 69*a* to 69*c* are formed so as to displace angle positions of the follower pins 56*a* to 56*c* gradually with respect to the rotating shaft 49.

In this Embodiment, the follower pin support portion 69*b* of the pressing plate 53*b* at the center extends in the same plane as the pressing plate, and the cam follower pin 56*b* is provided to be opposed to, at the front, the outer surface of the cylindrical cam 40 along the line M shown in FIG. 5A. In contrast thereto, in the pressing plates 53*a*, 53*c* on the front side and rear side, each of the follower pin support portions 69*a*, 69*c* is bent in the shape of a mountain for protruding outward with respect to the center follower pin support portion 69*b* in the out-of-plane direction. By this means, the cam follower pins 56*a*, 56*c* on the front side and rear side are provided to face the rotation center axis of the cylindrical cam 40 respectively along the lines L, M shown in FIG. 5A. By this means, it is possible to reliably engage the cam follower pins 56*a* to 56*c* in the cam groove 41.

Further, three pressing springs 61*a* to 61*c* made of tension springs each having the same tension strength are installed among the pressing plates 53*a* to 53*c*, front plate 51 and base plate 52. By this means, the pressing plates 53*a* to 53*c* are always biased downward in a direction in which the pressing teeth 55*a* to 55*c* apply pressure to the receiving tooth 59.

As shown in FIGS. 5A and 5B, in the center pressing spring 61*b*, its upper end is fastened to the spring fastening portion 62*b* at the upper end of the center pressing plate 53*b*, and its lower end is fastened to the joint pin 64*b*. In the pressing springs 61*a*, 61*c* on the front side and rear side, their upper ends are fastened to the spring fastening portions 62*a*, 62*c* at the upper ends of the pressing plates 53*a*, 53*c* on the front side and rear side, and their lower ends are fastened to the joint pin 64*a*, respectively. As described above, the center spring fastening portion 62*b* and joint pin 64*b* are disposed with their positions slightly displaced to the notch opening side from the other spring fastening portions 62*a*, 62*c* and joint pin 64*a*. By this means, without expanding a gap between the front plate 51 and the base plate 52, it is possible to arrange three pressing springs 61*a* to 61*c* in the narrow gap.

When the press bind motor 46 is rotated to rotate the cylindrical cam 40 in a clockwise direction in the figure, the pressing plates 53*a* to 53*c* are moved down in the direction of pressing sheets on the placement portion 31. At this point, the pressing plates 53*a* to 53*c* are acted upon downward by both the rotation drive force of the press bind motor 46 via the cylindrical cam 40 and the tension force of the pressing springs 61*a* to 61*c*. Thus, by configuring that a part of the pressing force of the pressing teeth 55*a* to 55*c* to the receiving tooth 59 is obtained from the pressing springs 61*a* to 61*c*, it is possible to decrease output of the press bind motor 46 itself to store in the narrow gap between the front plate 51 and the base plate 52, and to actualize miniaturization.

When the cylindrical cam 40 is rotated in a counterclockwise direction in the figure by the press bind motor 46, the pressing plates 53*a* to 53*c* are moved up in a direction of separating from the placement portion 31. At this point, the biasing force of the pressing springs 61*a* to 61*c* acts on the press bind motor 46 as resistance. Accordingly, the press bind motor 46 needs output for at least enabling the pressing plates 53*a* to 53*c* to be moved up smoothly against the biasing force of the pressing springs 61*a* to 61*c*.

[Cylindrical Cam Operation in Press Binding]

Hereinafter, referring to FIGS. 12A to 13F, press binding will be described with emphasis on operation of the cylindrical cam 40 for performing press binding. In the press bind unit 82, by the cylindrical cam 40 rotating substantially twice, the pressing plates 53*a* to 53*c* shift down approximately perpendicularly, and the pressing teeth 55*a*, 55*b*, 55*c* sequentially sandwich a bunch of sheets ST and press the receiving tooth 59 to crimp. Developed views of FIGS. 12A to 13F illustrate a position relationship between a track of the cam follower pins 56*a* to 56*c* that shift along the cam groove 41 for a period during which the cylindrical cam 40 rotates twice, and the receiving tooth 59 of each of the pressing teeth 55*a* to 55*c* corresponding to height positions of the pressing plates 53*a* to 53*c* at this point.

Figure 12A:
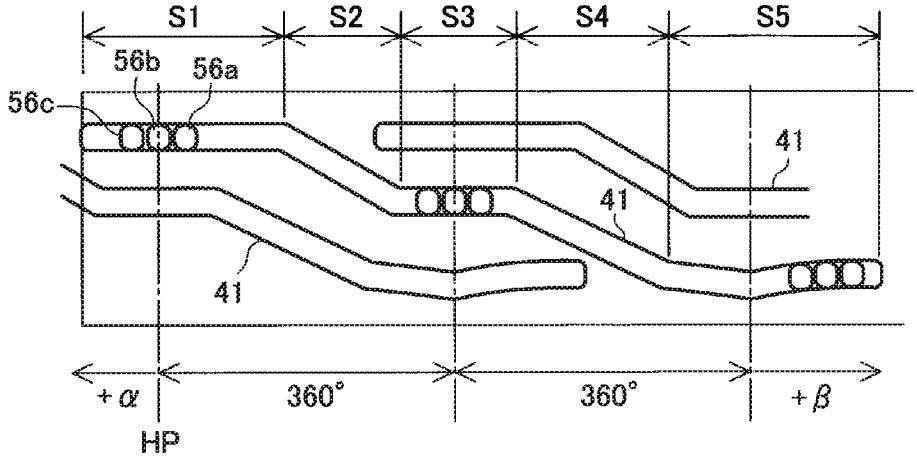
FIG. 12A is a developed view of a cam groove of the cylindrical cam.

As shown in FIG. 12A, along the circumferential direction of the cylindrical cam 40, the cam groove 41 is comprised of a horizontal region S1 (that corresponds to "retract position" described later) in a highest position in the shaft line direction of the cam 40, a region S2 that is inclined substantially a certain angle downward from the region S1, a horizontal region S3 (that corresponds to "sheet receiving position" described later) in a position of rotating substantially 360° from the region S1, a region S4 (that corresponds to "intermediate position" described later") which is inclined substantially a certain angle downward from the region S3, and a last region S5. As described later in relation to FIG. 13A, in the region S5 (that corresponds to "press position" described later), press operation is performed by the shift in the approximately perpendicular direction by the pressing teeth 55*a* to 55*c*.

Figure 12B:
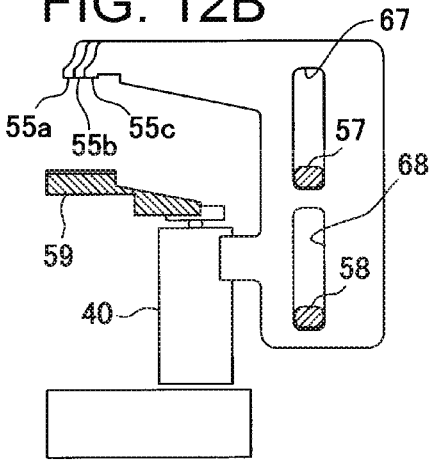
FIGS. 12B to 12E are explanatory views illustrating shifts of the pressing plates in association with rotation of the cylindrical cam.

First, the cam follower pins 56*a* to 56*c* wait in a home position HP in the region S1. FIG. 12B illustrates a state in which each of the pressing plates 53*a* to 53*c* is in the top dead center position. At this point, a slight gap is formed between the guide pins 57, 58 of the base plate 52 and lower ends of the guide slots 67, 68 of each of the pressing plates 53*a* to 53*c*. By this means, when the pressing plates 53*a* to 53*c* arrive at the top dead center position, the guide pins 57, 58 are prevented from colliding with the lower ends of the guide slots 67, 68 to generate a rattle, or being damaged.

Figure 21:
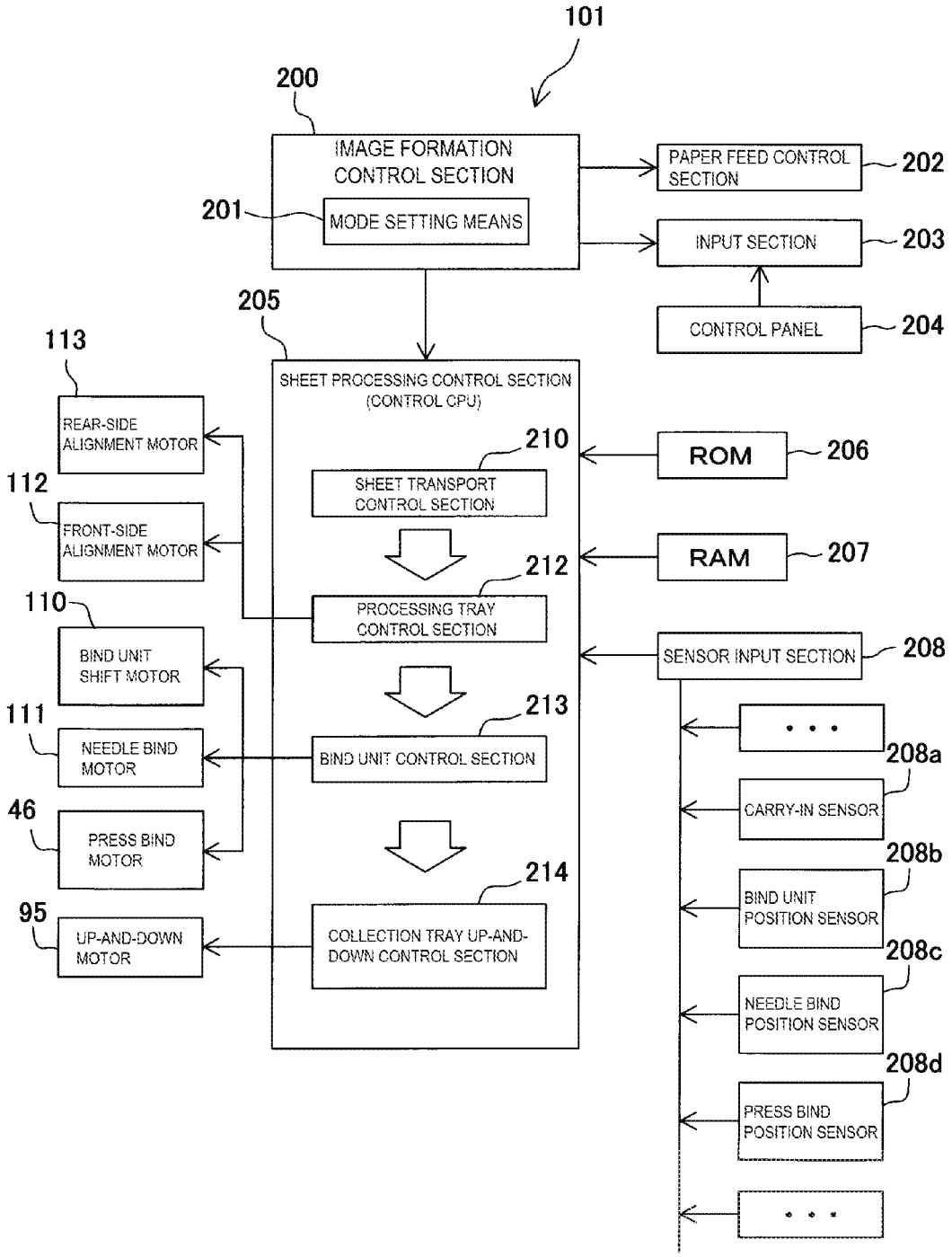
FIG. 21 is a block diagram illustrating a control configuration of an image formation apparatus including the sheet processing apparatus of this Embodiment.

In this state, in performing press binding operation of a bunch of sheets ST sequentially fed from the image formation section 2, a bind unit control section 213 of a sheet processing control section 205 shown in FIG. 21 controls the bind unit shift motor 110, and shifts the press bind unit 82 to a press bind portion of the bunch of sheets ST. Then, the bind unit control section 213 drives the press bind motor 46 to rotate the cylindrical cam 40 in the clockwise direction in the figure. By this means, the cam follower pins 56*a* to 56*c* shift relatively along the cam groove 41, and for a period during which the pins engage in the cam groove 41 in the region S1, the height position of each of the pressing plates 53*a* to 53*c* is not changed, and is held in the state shown in FIG. 12B.

When the cam follower pins 56*a* to 56*c* shift from the region S1 to the region S2 of the cam groove 41, the positions of the cam follower pins 56*a* to 56*c* are sequentially lowered along inclination of the region S2, and in association therewith, combined with the tension force of the pressing springs 61*a* to 61*c*, each of the pressing plates 53*a* to 53*c* mutually adjoins downward to shift, while sliding. This is a state shown in FIG. 12C.

Figure 12D:
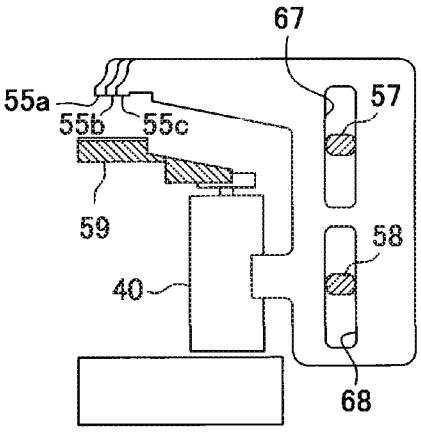
Figure 12C:
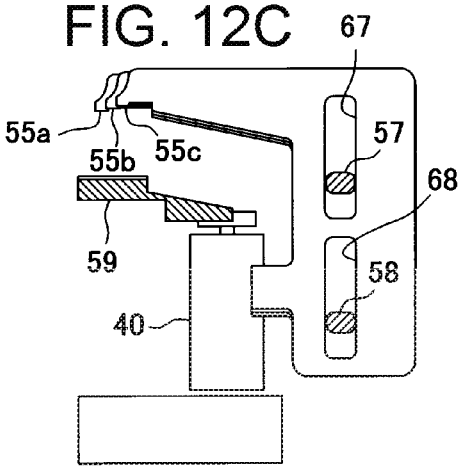

Further, when rotation of the cylindrical cam 40 proceeds and the cam makes an about one rotation from the home position HP, the cam follower pins 56*a* to 56*c* shift from the region S2 to the region S3 of the cam groove 41. Since the region S3 corresponds to the sheet receiving position of FIGS. 11 and 17B, and the cam groove is formed horizontally, as shown in FIG. 12D, the pressing plates 53*a* to 53*c* are aligned in a height position about ⅓ to ½ the distance between the receiving tooth 59 and the plates in an initial state. In this state, the press bind unit 82 waits for that the sheet is transported to the placement portion 31, and the sheet guide 86 sags downward to narrow an entrance opening of the placement portion 31, and guides a fed sheet.

When all sheets undergoing press binding are transported to the placement portion 31, second-loop rotation of the cylindrical cam 40 is started, and crimping is performed by nipping a bunch of sheets ST by the pressing teeth 55*a* to 55*c* and the receiving tooth 59. Accordingly, when press binding is indicated, the press bind unit 82 rotates the cylindrical cam 40 one loop instantaneously, waits for that sheets are transported to the placement portion 31, and when all the sheets are transported, performs crimping by rotation of second-loop rotation, and therefore, it is possible to perform press binding in a short time.

Figure 12E:
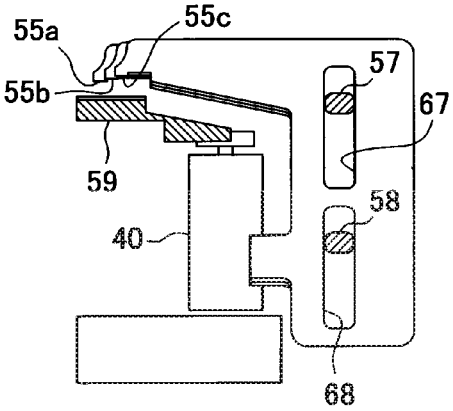

In the second-loop rotation of the cylindrical cam 40, the region where the cam follower pins 56*a* to 56*c* engage in the cam groove 41 is switched from S3 to S4. S4 is a region where the groove is inclined again, and as shown in FIG. 12E, the position of the follower pins 56*a* to 56*c* is lowered.

When the cylindrical cam 40 makes near two rotations from the home position HP, the cam follower pins 56*a* to 56*c* shift from the region S4 to the region S5 of the cam groove 41. The region S5 includes the press position of a region where the pressing teeth 55*a* to 55*c* nip a bunch of sheets ST and sequentially press the receiving tooth 59, and press binding is thereby formed.

Figure 13A:
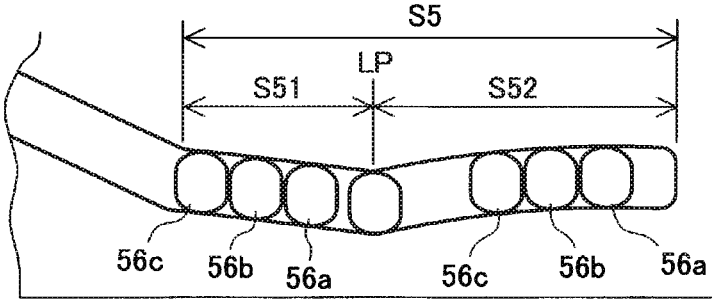
FIG. 13A is a partial developed view illustrating a region S5 of the cam groove of the cylindrical cam.
Figure 13B:
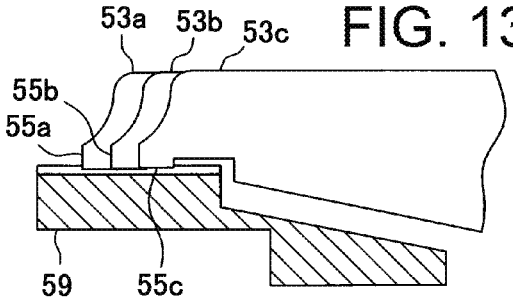
FIGS. 13B to 13F are explanatory views illustrating shifts and pressing operation of the pressing plates in associated with rotation of the cylindrical cam continued from FIG. 12E.

FIGS. 13A to 13F illustrate press operation performed by the cam follower pins 56*a* to 56*c* engaging in the region S5 of the cam groove 41. As shown in FIG. 13A, the region S5 of the cam groove 41 is divided into an S51 region continued to the region S4, and an S52 region reaching a lower end portion of the cam groove 41 with the lowest point LP as a boundary. The S51 region is a groove inclined downward moderately, and as shown in FIG. 13B, as the teeth proceed toward the lowest point LP, height positions of the pressing teeth 55*a*, 55*b*, 55*c* are gradually lowered sequentially starting with the pressing tooth 55*a* to mesh with the receiving tooth 59.

Figure 13C:
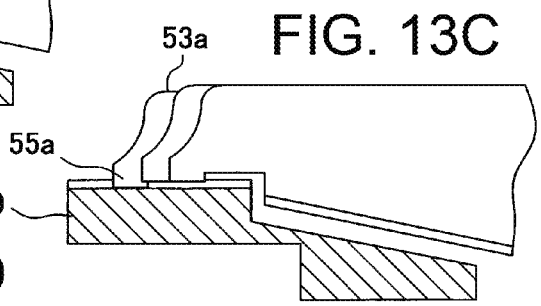
Figure 13D:
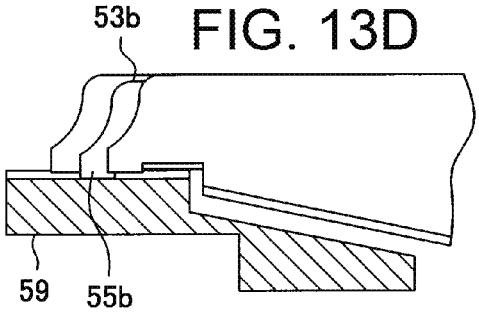
Figure 13E:
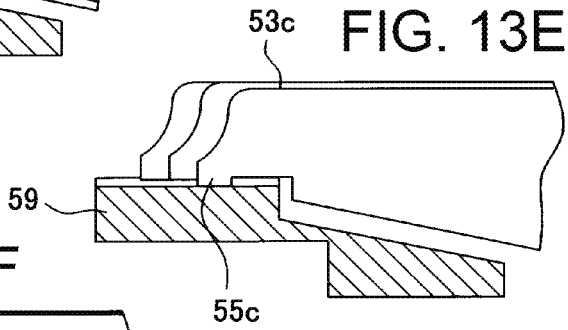

Whenever the cam follower pins 56*a* to 56*c* sequentially pass through the lowest point LP of the cam groove 41 one by one, as shown in FIGS. 13C to 13E, the pressing teeth 55*a* to 55*c* are pressed to the receiving tooth 59 by strong pressure i.e. by pressing force larger than in the region S51 to be driven. As described above, since the teeth are divided into three pressing teeth, the pressing area by one pressing tooth is only ⅓ the entire pressing area. Accordingly, it is possible to crimp a bunch of sheets ST strongly by a pressing load smaller than in the case of pressing the entire pressing area at a time by a single pressing tooth.

At this point, as shown in FIGS. 10 and 18A, each of the pressing plates 53*a* to 53*c* is in the bottom dead center position, and a slight gap is formed between the guide pins 57, 58 of the base plate 52 and upper ends of the guide slots 67, 68 of each of the pressing plates 53*a* to 53*c*. By this means, when the pressing plates 53*a* to 53*c* arrive at the bottom dead center position, the guide pins 57, 58 are prevented from colliding with the upper ends of the guide slots 67, 68 to generate a rattle, or being damaged At this point, the pressing teeth 55*a* to 55*c* are provided with the tension force of respective pressing springs 61*a* to 61*c* as the pressing force to the receiving tooth 59. As described above, since the pressing load necessary for each of the pressing teeth 55*a* to 55*c* is only low, the weak spring force is enough for each of the pressing springs 61*a* to 61*c*, and it is possible to also decrease the dimensions thereof. Accordingly, it is possible to miniaturize the entire apparatus. Further, since the guide pins 57, 58 are provided to be spaced a certain clearance away from the upper ends of the guide slots 67, 68 of each of the pressing plates 53*a* to 53*c* also after pressing, pressing is reliably performed.

When the pressing teeth 55*a* to 55*c* come into contact with the receiving tooth 59 with a bunch of sheets ST therebetween, there is the risk that the cam groove 41 and the follower pins 56*a* to 56*c* are locked by a thrust load generated in the shaft direction of the cylindrical cam 40 by a thickness of the bunch of sheets ST. In this Embodiment, as shown in FIG. 6B, the thrust load is received evenly in the circumference direction by the spring washer 96 provided between the bearing 43 and the cylindrical cam 40, and the lock between the cam groove 41 and the cam follower pins 56*a* to 56*c* is thereby prevented from occurring.

Figure 13F:
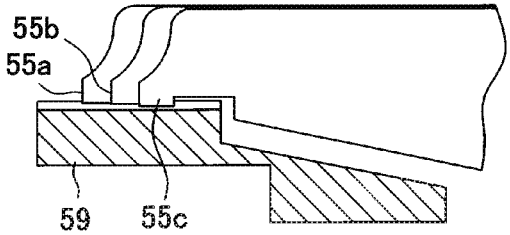

When the cam follower pins 56*a* to 56*c* pass through the lowest point LP, since the S52 region of the cam groove 41 is a groove inclined upward, meshing of the pressing teeth 55*a* to 55*c* with the receiving tooth 59 is gradually shallower starting with the pressing tooth 55*a*, and is in a state shown in FIG. 13F. At this point, as shown in FIG. 10, in each of the pressing plates 53*a* to 53*c*, since the guide pins 57, 58 are fitted into two guide slots 67, 68 provided vertically, respectively, the pressing plates 53*a* to 53*c* do not rotate by the tension force of the pressing springs 61*a* to 61*c*, and are moved upward reliably by rotation of the cylindrical cam 40. In addition, as shown in FIG. 10, when the pressing plates 53*a* to 53*c* release contact with the sheet guide 86, the sheet guide 86 narrows an opening on the entrance side of the placement portion 31 of a bunch of sheets ST, and is capable of also guiding introduction of a subsequent sheet.

When the cylindrical cam 40 makes about two rotations in the clockwise direction, and sequential pressing to the receiving tooth 59 by the pressing teeth 55*a* to 55*c* is finished, the bind unit control section 213 shown in FIG. 21 next rotates the press bind motor 46 backward, and performs control to return the pressing plates 53*a* to 53*c* to the home position HP. Accordingly, when the cylindrical cam 40 rotates in the counterclockwise direction in the figure, and the cam follower pins 56*a* to 56*c* shift from the region S52 to the region S51 of the cam groove 41, the pins sequentially pass through the lowest point LP again. At this point, starting with the pressing tooth 55*c* this time, the pressing tooth 55*b* and pressing tooth 55*a* sequentially pass through the strong pressure position in the lowest point LP, and second pressing to the receiving tooth 59 is performed by the tension force of the pressing springs 61*c* to 61*a*.

Then, the cylindrical cam 40 makes about two rotations in the counterclockwise direction, and the cam follower pins 56*a* to 56*c* follow the cam groove 41 inversely, and return to the home position HP. In association therewith, the slide guides 57, 58 of the base plate 52 shift relatively from the upper end to the lower end of long holes 67, 68 respectively, and therefore, the pressing plates 53*a* to 53*c* shift perpendicularly by the tension force of the pressing springs 61*a* to 61*c*. Accordingly, the cam mechanism by engagement of the cam groove 41 of the cylindrical cam 40 and the cam follower pins 56*a* to 56*c* controls the tension force of the pressing springs 61*a* to 61, and only in pressing, enables the tension force to be used in crimping a bunch of sheets ST.

[Press Binding Operation]

Figure 14:
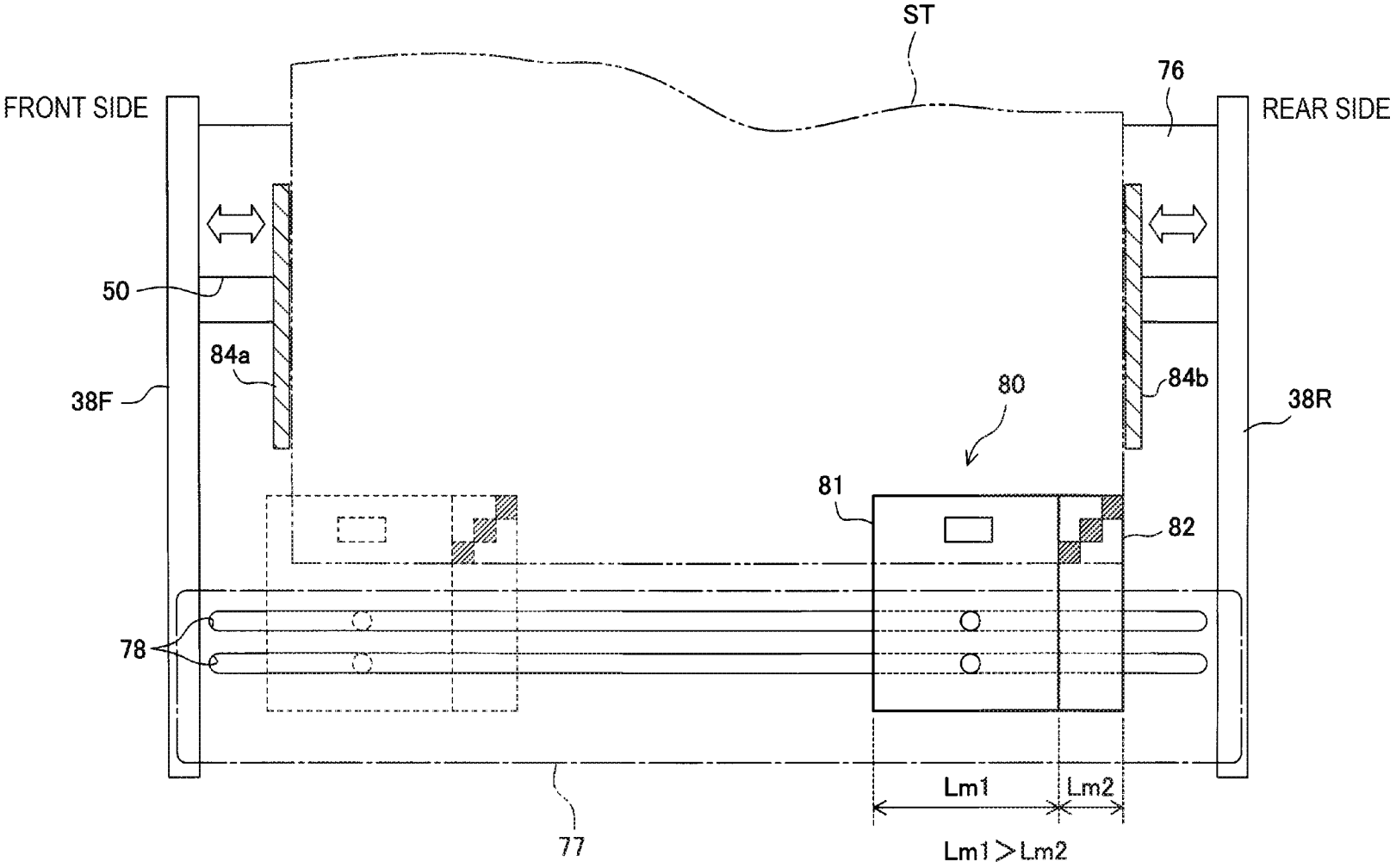
FIG. 14 is an explanatory view illustrating a position of the press bind unit in the case of performing press binding on sheets.

FIG. 14 illustrates a position of the sheet bind unit 80 along the shift bench 77, in the case of performing press binding on a bunch of sheets ST on the processing tray 76 with the press bind unit 82. In FIG. 14, a bunch of sheets ST is placed with its center position in the right-and-left direction aligned in the center position of the processing tray 76. At this point, the sheet bind unit 80 beforehand waits in a position slightly before a most outward position on the rear side on the processing tray 76.

In this state, a sheet is transported onto the processing tray 76, the alignment plates 84*a*, 84*b* on both left and right sides are driven to align in the center position of the processing tray 76, and this operation is repeated to form a bunch of sheets ST. At this point of time, in the bunch of sheets ST thus formed on the processing tray 76, the side portion is placed inside the placement portion 31 of the press bind unit 82 and the opening portion of the needle bind unit 81. By this means, a corner portion on the rear side of the bunch of sheets ST is positioned in the placement portion 31 of the press bind unit 82, and it is possible to press-bind the corner portion.

Further, in the press bind unit 82, in a waiting state of FIG. 14, the pressing plates 53*a* to 53*c* shift to the sheet receiving position. By this means, it is possible to shorten a vertical shift distance of the pressing plates required for press binding, and to suppress the processing time.

In another Embodiment, in the position of a bunch of sheets ST in FIG. 14, by shifting the sheet bind unit 80 to the front side, it is possible to perform press binding on a position different from the foregoing in the side portion of the bunch of sheets ST. Further, by changing the position in the right-and-left direction of the bunch of sheets ST by the alignment plates 84*a*, 84*b*, while fixing the position of the sheet bind unit 80, it is possible to similarly change a bind position of the bunch of sheets ST by press binding.

[Needle Binding Operation]

Figure 15:
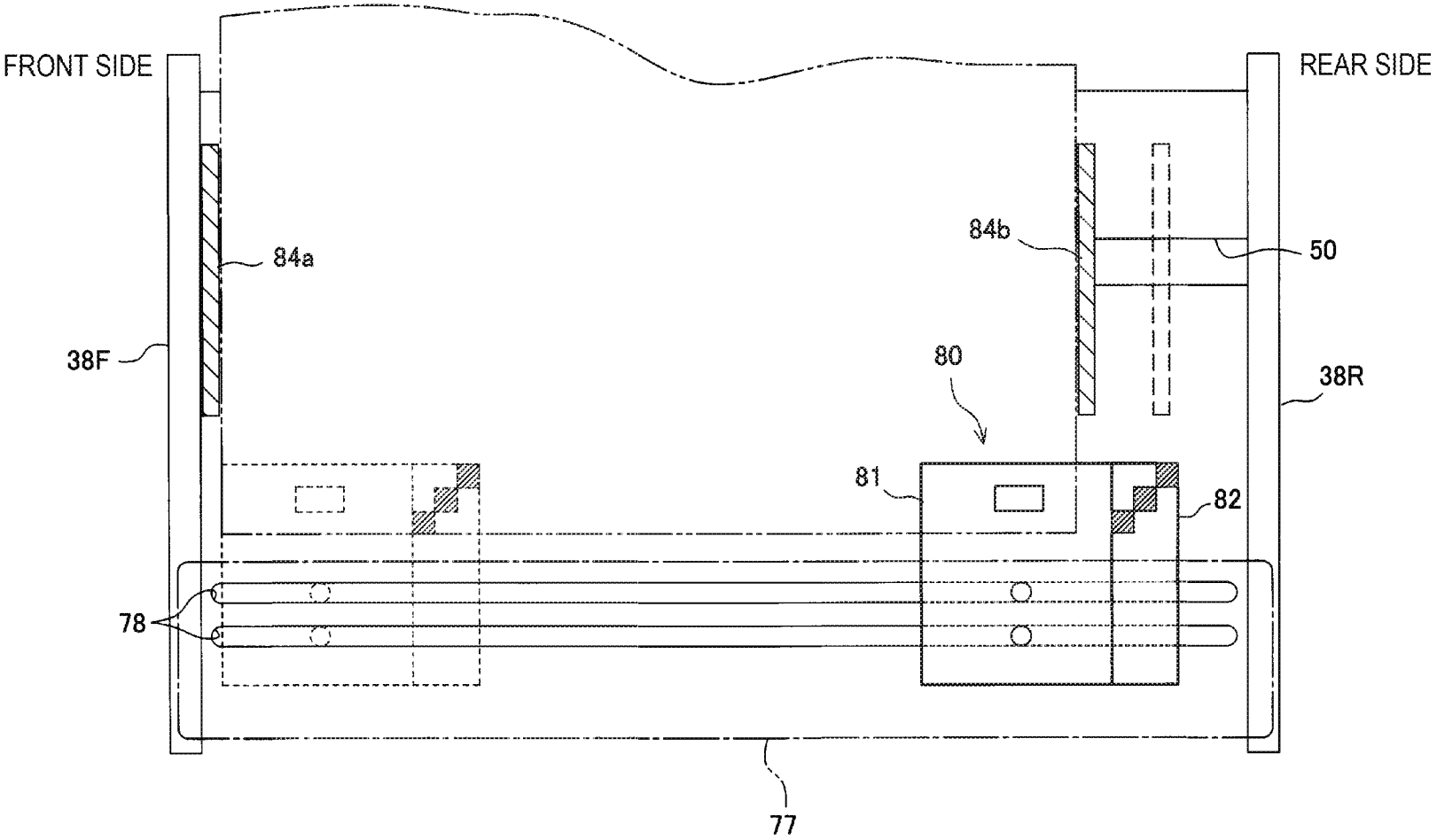
FIG. 15 is an explanatory view illustrating a position of the needle bind unit in the case of performing needle binding on a bunch of shifted sheets on the rear side.

FIG. 15 illustrates a position of the sheet bind unit 80 along the shift bench 77, in the case of performing needle binding on the corner portion on the rear side of a bunch of sheets ST on the processing tray 76 with the needle bind unit 81. In FIG. 15, the sheet bind unit 80 is disposed in the most outward position on the rear side on the shift bench 77. In the needle bind unit 81 in this Embodiment, the press bind unit 82 is provided together on the rear side, and therefore, the needle bind position is shifted to the front side, as compared with the case of the needle bind unit alone.

Therefore, in this Embodiment, a bunch of sheets ST, which is collated on the processing tray 76 by the alignment plates 84*a*, 84*b* on both left and right sides, is shifted to the front side again by the alignment plates, and its corner portion on the rear side is disposed in a bind position of the needle bind unit 81 i.e. table 87. At this point, in the press bind unit 82, the pressing plates (shift portions) 53*a* to 53*c* are in the top dead center position shown in FIGS. 5B, 16B, 17A and 17C, and the sheet guide 86 is also stored in the fixed arm portions of the front plate 51 and base plate 52. Accordingly, the placement portion 31 is expanded to the maximum ML1 region in the vertical direction, and space opened between the pressing teeth 55*a* to 55*c* and the receiving tooth 59 is maximum in the vertical direction (retract position). As a result, it is possible to shift a bunch of sheets ST disposed on the table 87 of the needle bind unit 81 smoothly, without the sheets being caught in the pressing teeth 55*a* to 55*c* and/or other portion of the press bind unit 82.

Particularly, also in the case of performing needle binding in a plurality of positions of a bunch of sheets ST of which the number is high, as shown in FIGS. 5B, 16B, 17A and 17C, as in the opening portion of the needle bind unit 81, the press bind unit 82 of this Embodiment is capable of expanding the placement portion 31 largely in the vertical direction. Accordingly, a smooth shift of the needle bind unit 81 is secured.

[Multiple Press Binding in Different Positions of a Bunch of Sheets]

In the explanation of FIG. 13A, it is shown that the pressing teeth 55*a* to 55*c* shift and perform pressing on the receiving tooth 59 twice, by shifting from the region S52 to the region S51 of the cam groove 41 by rotation in the counterclockwise direction shown in the figure of the cylindrical cam 40. FIG. 13A illustrates that multiple press binding processing is performed in the same position of a bunch of sheets ST, and hereinafter, the case of performing multiple press binding in different positions of the same bunch of sheets ST will be described with reference to FIGS. 18A to 19C.

First, as shown in FIG. 18A, press binding is performed in a first bind position. The pressing teeth 55*a* to 55*c* at this point sequentially press the receiving tooth 59 to perform press binding. A distance between the pressing teeth 55*a* to 55*c* and the receiving tooth 59 at this point is a nearest crimping position of a distance ML0. In addition, FIG. 18C shows a front view of FIG. 18A, and the distance ML0 is also shown herein.

Figure 18B:
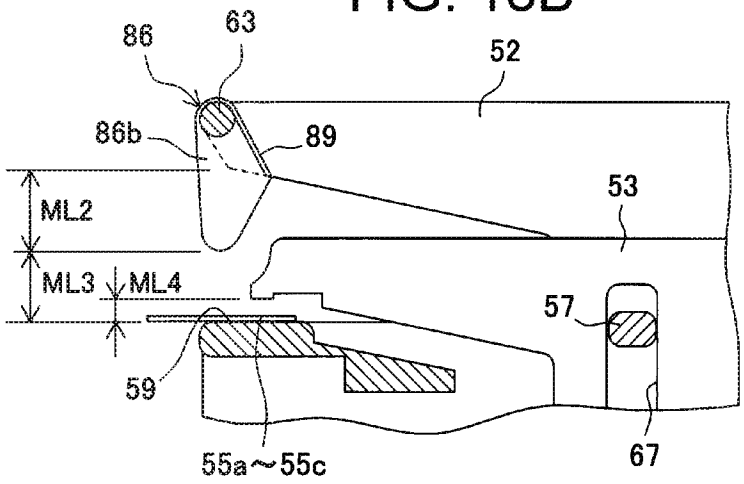
FIG. 18B is a cross-sectional view where the pressing tooth is in an intermediate position between the sheet receiving position and the press position for performing crimping again after crimping with the pressing tooth.
Figure 18C:
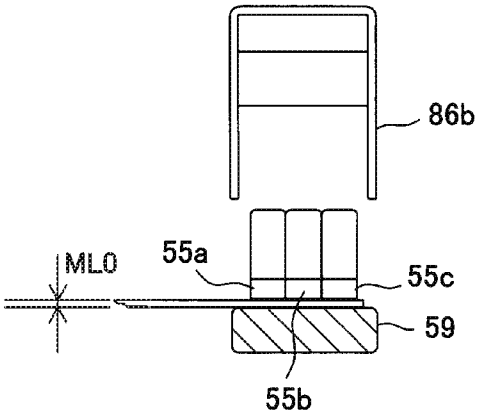
FIG. 18C is a front explanatory view of FIG. 18A.

Herein, in the case of performing press binding processing in different positions of the same bunch of sheets ST, the pressing plates 53*a* to 53*c* are shifted in an upward direction shown in the figure, and the pressing teeth 55*a* to 55*c* integrated with the pressing plates 53*a* to 53*c* are also shifted to provide a slight gap as shown in FIG. 18B. This shift is performed by rotation of the cylindrical cam 40 described in the foregoing, and is made to a predetermined position (that corresponds to the intermediate position) of the region S4 inclined a certain angle shown in FIG. 12A.

Figure 18D:
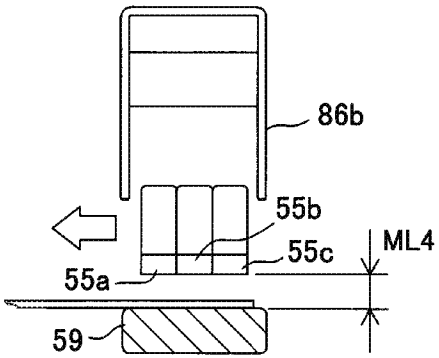
FIG. 18D is a front explanatory view of FIG. 18B.

As shown in FIGS. 18B and 18D which is a front view of FIG. 18B, the predetermined position shifts to the intermediate position (range of ML4 shown in the figure) between the receiving position (range of ML3 shown in the figure) of the pressing teeth 55*a* to 55*c* and sheet guide 86, and the press position (receiving tooth top surface ML0). The reason why the intermediate position (ML4) is set is that it takes a relatively time for the pressing teeth to shift for press binding, and that it is thereby intended to shorten the range to shift, and reduce time of the press binding processing. Further, in the intermediate position (ML4), since there is already little clearance in the bunch of sheets ST by first press binding, it is possible to set at a range significantly narrower than the initial sheet receiving position.

It is not necessary that the intermediate position is a middle position between the sheet receiving position and the press position in the shift direction of the pressing teeth 55*a* to 55*c*, and it is essential only that the intermediate position is between the sheet receiving position and the press position, and is a position where the pressing teeth 55*a* to 55*c* separate from the first press bind position. Further, the intermediate position is a position in which the pressing teeth 55*a* to 55*c* do not contact the sheet guide 86, and needless operation of the sheet guide 86 is eliminated.

Figure 19B:
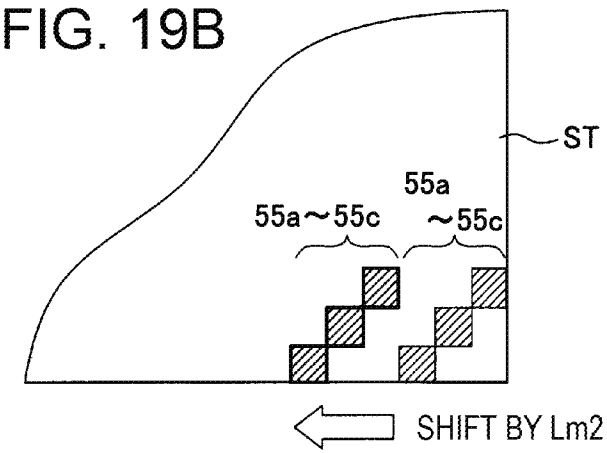
FIG. 19B is a view illustrating press traces obtained by performing multiple press binding.
Figure 19C:
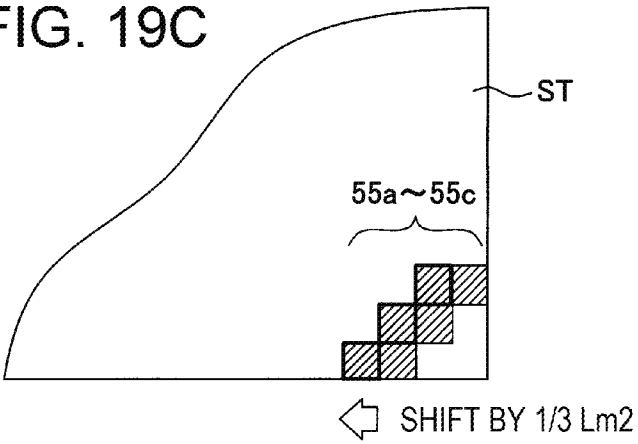
FIG. 19C is a view illustrating a Modification of the press traces.
Figure 19A:
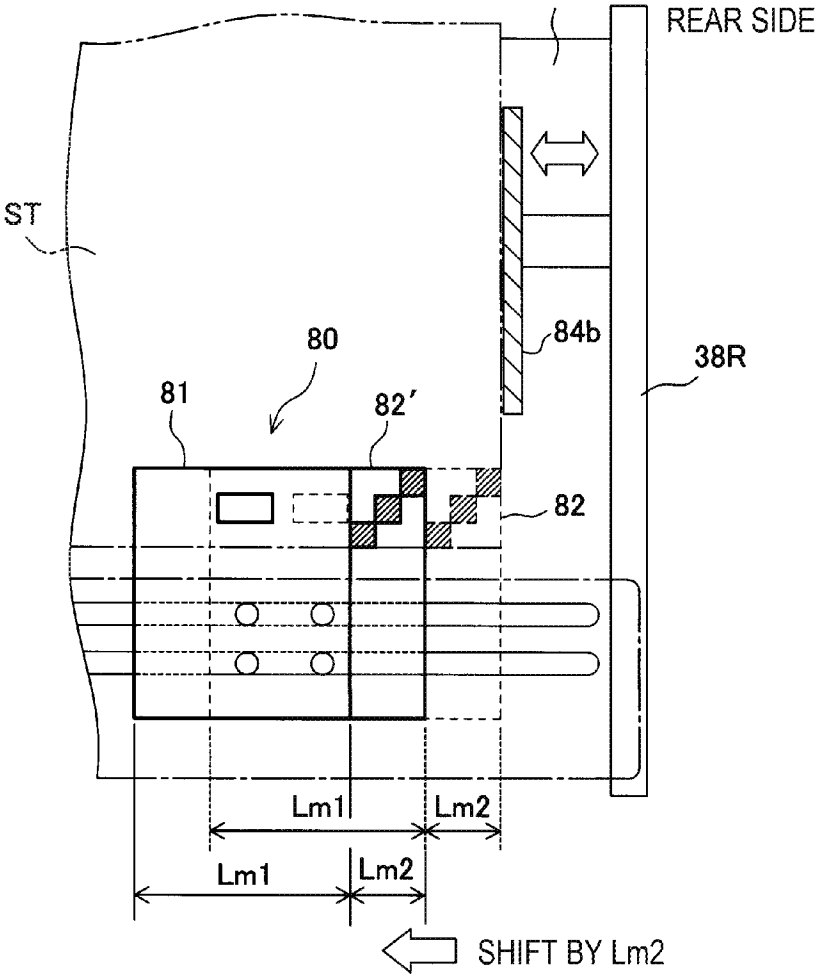
FIG. 19A is a view where the press bind unit shifts to the front side to perform crimping again after crimping with the pressing tooth corresponding to FIG. 18B.

After shifting the pressing teeth 55*a* to 55*c* to the intermediate position, the bind unit 80 including the press bind unit 82 is shifted to the solid-line position in FIG. 19A. In this figure, the bind unit 80 is shifted to the front side corresponding to Lm2 that is the width of the press bind unit 82. After the shift, the cylindrical cam 40 is rotated in the original direction, the pressing teeth 55*a* to 55*c* press the receiving tooth 59 again, and it is thereby possible to perform the press binding processing in the position displaced by Lm2.

FIG. 19B illustrates press traces in a state in which the pressing teeth 55*a* to 55*c* press the same bunch of sheets ST in the position displaced by Lm2. Further, FIG. 19C illustrates a state of press traces obtained by shifting the bind unit 80 to the front side in a range one-third (⅓) Lm2 and performing press binding. By thus varying the shift range of the bind unit 80 to the front side, different press traces are made in the bunch of sheets ST, and it is possible to change bind positions corresponding to the number of binding sheets and binding sheet type. Further, in the case of shifting to a different bind position inside the same bunch of sheets ST, the pressing teeth 55*a* to 55*c* shift to the intermediate position (range of ML4) nearer the receiving tooth 59 (press position) than the sheet receiving position, the shift distance of the pressing teeth 55*a* to 55*c* is shortened, and it is thereby possible to reduce multiple binding processing time.

In addition, in the above-mentioned Embodiment, the ascent of the pressing teeth 55*a* to 55*c* is once halted in the intermediate position, and then, the bind unit is shifted to the front side. Alternatively, without halting an up-and-down shift of the pressing teeth 55*a* to 55*c*, the shift of the bind unit 80 to the front side may be started when the pressing teeth 55*a* to 55*c* are in a state of separating from the receiving tooth 59, and by this means, it is possible to shorten the processing time. It is essential only that the pressing teeth 55*a* to 55*c* are shifted to a position that enables a bunch of sheets ST to be shifted to between the sheet receiving position and the press position in the width direction. Further, in the foregoing explanation, in the case of performing press binding in a different position of the same bunch of sheets ST, the press bind unit 80 is shifted, and the bunch of sheets ST may be shifted in the width direction using the alignment plates 84*a*, 84*b* and the like with the press bind unit 80 fixed.

[Modifications of the Cam Groove of the Cylindrical Cam]

Figure 20A:
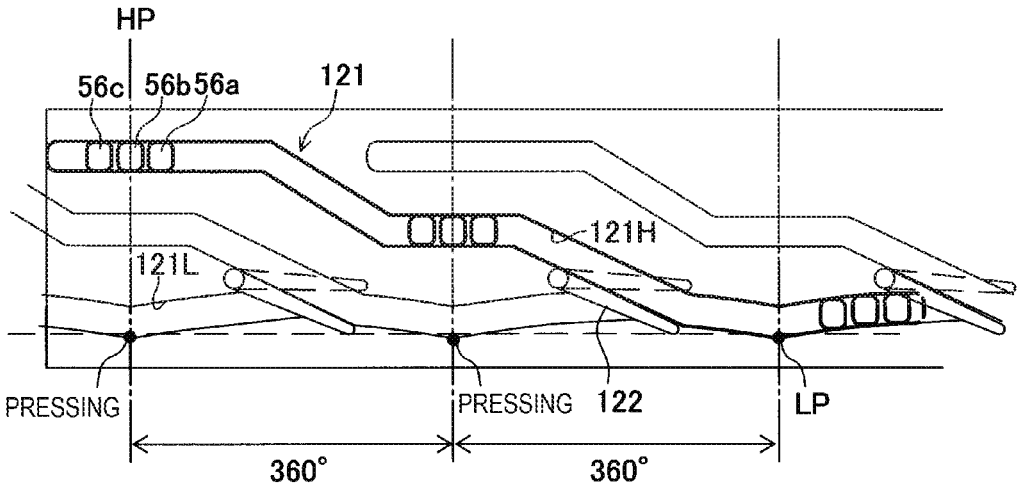
FIGS. 20A and 20B are developed views respectively illustrating Modifications of the cam groove shown in FIG. 12A.

FIG. 20A illustrates a Modification of the cam groove 41 formed in the cylindrical cam 40. A cam groove 121 is the same as the cam groove 41 until arrival at the lowest position LP, and subsequent thereto, a groove portion 121L is continuously provided in the shape of snaking vertically in same height positions of the cam circumference. In this case, in a portion where the groove portion 121L snaking by rotation of the cylindrical cam 40 crosses an upper groove portion 121H reaching the groove portion 121L, a gate 122 that opens/closes in one direction is provided to enable the cam follower pins 56*a*, 56*b*, 56*c* to shift only in the direction along rotation of the cylindrical cam 40.

When the cylindrical cam 40 provided with such a cam groove 121 is rotated, as in the case of the cam groove 41, the cam follower pins 56*a*, 56*b*, 56*c* positioned in the home position HP follow the cam groove 121 and shift downward in the cylindrical cam 40. However, when the cam follower pins 56*a*, 56*b*, 56*c* arrive at the groove portion 121L, the pins snake along the shape of the groove portion 121L and shift in the horizontal direction. Accordingly, whenever the cam follower pins 55*a*, 56*b*, 56*c* pass through a valley portion of snaking, the pressing plates 55*a*, 55*b*, 55*c* sequentially press the receiving tooth 59 a plurality of times by the tension force of the pressing springs 61*a*, 61*b*, 61*c*.

Then, when the cam follower pins 55*a*, 56*b*, 56*c* follow the groove portion 121L and arrive at the gate 122, the pins push the gate 122 aside, and return to the beginning of the groove portion 121L again. Subsequently, for a period during which rotation of the cylindrical cam 40 is continued, the cam follower pins 55*a*, 56*b*, 56*c* continue to travel in the groove portion 121L, and whenever arriving at the valley portion of snaking, the pressing teeth 55*a*, 55*b*, 55*c* perform pressing. Accordingly, the groove portion 121L is set in the shape of pressing a bunch of sheets ST a plurality of times, by the pressing teeth 55*a*, 55*b*, 55*c* repeating the shift between the position separated upward from the receiving tooth 59 and the press position. By this means, the bunch of sheets ST is subjected to press binding firmly.

Next, when the cylindrical cam 40 is rotated backward, the cam follower pins 55*a*, 56*b*, 56*c* follow the groove portion 121L in the opposite direction, are introduced to the groove portion 121H by the gate 122 when arriving at the beginning of the groove portion 121L, follow the cam groove 121 inversely, and return to the home position HP. In addition, when the cylindrical cam 40 is rotated backward, for a period during which the cam follower pins 55*a*, 56*b*, 56*c* shift in the groove portion 121L of the cam groove 121, whenever the pins pass through the valley portion of snaking, the pressing plates 55*a*, 55*b*, 55*c* press the receiving tooth 59.

Figure 20B:
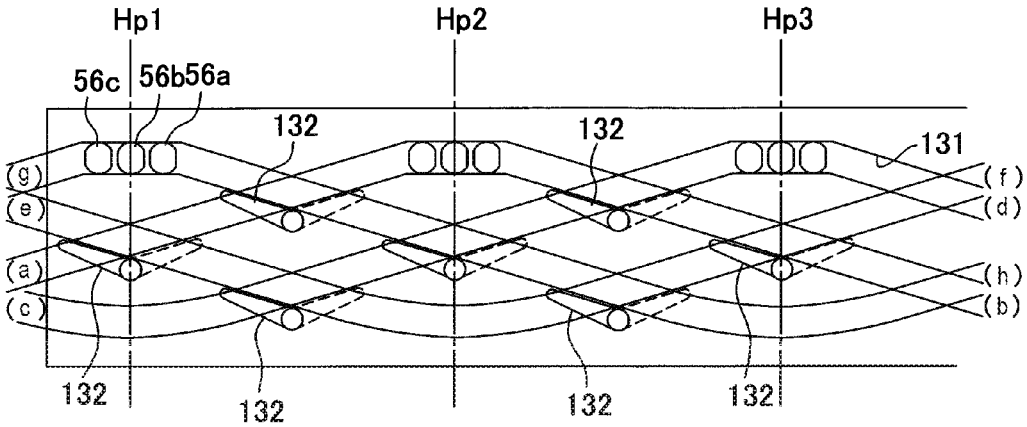

FIG. 20B illustrates an Embodiment where in the circumference surface of the cylindrical cam 40 is formed a cam groove 131 in the shape of a spiral repeated endlessly from above to below and from below to above. The cam groove 131 in this case is connected in a closed loop as shown by (a)-(b)-(c)-(d)-(e)-(f)-(g)-(h)-(a) in FIG. 20B. In the endless cam groove 131, even when the cylindrical cam 40 rotates forward and backward and causes a difference in the rotation direction, tracks traced by cam follower pins 55*a*, 56*b*, 56*c* are the same. Accordingly, in the cam groove 131, a gate 132 for switching between two directions corresponding to the direction along rotation is provided in each portion where the grooves cross.

According to the cam groove 131 in such a shape, even in the case where rotation of the press bind motor 46 is one direction (for example, clockwise rotation), when the cam follower pins 55*a*, 56*b*, 56*c* are positioned in a mountain portion in the highest position of the cylindrical cam 40, the pressing plates 53*a*, 53*b*, 53*c* are in the home position HP, and when the pins are positioned in a valley portion in the highest position, sequential pressing to the receiving tooth 59 by the pressing teeth 55*a*, 55*b*, 55*c* is performed by descent of the pressing plates 53*a*, 53*b*, 53*c*. In this case, when the gate 132 is closed, the cam follower pins 55*a*, 56*b*, 56*c* following the cam groove 131 push the gate aside to switch. Accordingly, by rotation in one direction of the press bind motor 46, the pressing teeth 55*a*, 55*b*, 55*c* shift between the press position and the position separated upward from the receiving tooth 59, and crimp the bunch of sheets ST repeatedly. As a matter of course, when the gate is disposed as shown by dotted lines shown in the figure, the same operation is performed also by backward rotation (i.e. counterclockwise rotation) of the press bind motor 46.

[Control Configuration]

FIG. 21 illustrates a configuration of a control apparatus 101 of the image formation system according to this Embodiment. The control apparatus 101 is comprised of an image formation control section 200 that controls image formation operation in the image formation apparatus A, and a sheet processing control section 205 that controls post-processing operation in the sheet processing apparatus B.

The image formation control section 200 is provided with a mode setting means 201 to set an image formation made and finish mode. The finish mode includes a binding processing mode for collating and collecting sheets with images formed to perform binding processing, and a print-out mode for storing sheets in the collection tray 90 without performing binding processing, and is set at one of modes by a user of the image formation system.

In the image formation system, an input section 203 having a control panel not shown is disposed on the front side, and a user of the image formation system inputs desired finish mode, sheet size and binding mode to designate from the input section 203. When these setting are performed, the image formation control section 200 transmits the set descriptions to the sheet processing control section 205 with a finish mode instruction signal S1, sheet size signal S2, binding mode instruction signal S3 and the like.

The sheet processing control section 205 controls post-processing operation performed on fed sheets with images formed in the image formation apparatus A. The sheet processing control section 205 is comprised of a CPU, executes control programs stored in ROM 206, thereby actualizes each function of a sheet transport control section 210, processing tray control section 212, bind unit control section 213 and collection tray up-and-down control section 214, and performs post-processing operation. RAM 207 stores data required for execution of the control programs. Then, to the sheet processing control section 205 is input a detection signal from each sensor disposed in each portion of the sheet processing apparatus B via a sensor input section 208.

When a carry-in sensor 208*a* detects that a sheet with an image formed in the image formation apparatus A is fed from the discharge roller 14, the sheet transport control section 210 controls operation of rollers and the like of each transport system in the sheet processing apparatus B, and receives the fed sheet so as to perform predetermined post-processing corresponding to the descriptions shown by the finish mode instruction signal S1, sheet size signal S2, and binding mode instruction signal S3 output from the image formation control section 200.

The processing tray control section 212 controls rotation of alignment motors 112 and 113 respectively on the front side and rear side for shifting the alignment plates 84*a*, 84*b* to perform positioning of the sheet in the transport orthogonal direction, so as to collate and collect sheets transported from the image formation apparatus A on the processing tray 75 in executing the binding processing mode.

Based on the sheet size signal S2 and binding mode instruction signal S3, the bind unit control section 213 controls operation of needle binding or press binding corresponding to a size of fed sheets. At this point, the bind unit control section 213 controls the bind unit shift motor 110 so as to shift and halt the bind unit 81 with a bind unit position sensor 208*b*. In needle binding, based on a detection signal from a needle bind position sensor 208*c*, the section 213 controls drive of the needle bind motor 111 so as to perform needle binding on a bunch of sheets ST in a predetermined needle bind position. In press binding, based on a detection signal from a press bind position sensor 208*d*, the section 213 controls drive of the press bind motor 46 so as to perform press binding on a bunch of sheets ST in a predetermined press bind position.

Further, as described already, by controlling the bind unit shift motor 110, the bind unit 80 is shifted between the front side and the rear side as shown in FIG. 19A, and by driving the press bind motor 46, press traces shown in FIGS. 19B and 19C are made to enable press binding to be performed.

Based on a detection signal from a sheet height position sensor 208*e*, the collection tray up-and-down control section 214 controls drive of the up-and-down motor 95 so as to hold a height position of sheets collected on the collection tray 90 in a predetermined height position.

As described above, according to the sheet processing apparatus of the Embodiment, the following effects are exerted. First, as the first disclosure herein, the apparatus is provided with the placement tray (processing tray 76) to place sheets to undergo binding processing, and the press bind unit 82 capable of shifting along the end edge of sheets (bunch of sheets ST) on the placement tray, the press bind unit 82 includes the receiving tooth 59, and pressing teeth 55*a* to 55*c* which mesh with the receiving tooth to perform press binding on the sheets nipped therebetween, and the pressing teeth are provided to be able to shift between a press position (ML0) for meshing with the receiving tooth, and a retract position (ML1) spaced apart from the receiving tooth so as to shift the press bind unit 82 along the end edge of sheets with the sheets disposed between the receiving tooth and the pressing teeth.

By shifting the pressing teeth to the retract position as described above, it is possible to shift the sheet bind apparatus smoothly along the end edge of a bunch of sheets with the sheets disposed between the receiving tooth and the pressing teeth.

Next, as the second disclosure herein, it is disclosed that the press bind unit 82 is provided with a receiving portion including an opening to receive a part of a bunch of placed sheets ST, pressing teeth 55*a* to 55*c* that press from the frontside and backside of a bunch of sheets received in the receiving portion in a bind position to crimp the sheets, and the sheet guide 86 provided in the receiving portion to guide a sheet to carry in to the bind position, and that the sheet guide 86 is held to shift between the guide position (ML3) for narrowing the opening to carry the sheet in the bind position and the expanded position (ML1) with an opening wider than the opening, in conjunction with a shift in a pressing direction of the pressing teeth.

By this means, also in carrying sheets in the press bind unit for pressing a bunch of sheets to bind, the sheet guide for guiding the sheet is held to shift in conjunction with the shift of the pressing teeth, and it is thereby possible to carry the sheet in a press position stably without needing particular drive for the shift of the sheet guide and the like.

Further, as the third disclosure, it is shown that a sheet processing apparatus is comprised of the bind unit 80 that shifts along the end edge of a bunch of sheets ST placed on the placement tray (processing tray 76), the bind unit 80 is provided with a receiving portion including an opening to receive a part of a bunch of placed sheets, a bind portion that binds the bunch of sheets received in the receiving portion in a bind position, and the sheet guide 86 provided in the receiving portion to guide a bunch of sheets to carry in to the bind position, and that the sheet guide 86 is able to be positioned in the guide position (ML3) for narrowing the opening to carry in the sheets and in the expanded position (ML1) with an opening wider than the opening, and when the bind unit shifts along the end edge of a bunch of sheets, is positioned in the expanded position (ML1).

By this means, when the bind unit for shifting along the sheet edge shifts along the sheet end edge, the bind opening is expanded at the time of shifting, and it is possible to reduce the occurrence of a jam caused by catching the sheet due to the shift.

Then, as the fourth disclosure herein, a sheet processing apparatus is provided with the placement tray (processing try 76) to place sheets to undergo binding processing as a bunch, and the press bind unit 82 that is able to shift along the end edge of a bunch of sheets ST on the placement tray, and the press bind unit 82 is provided with the receiving tooth 59, and the pressing teeth 55*a* to 55*c* which mesh with the receiving tooth to perform press binding on the bunch of sheets ST nipped therebetween, where the pressing teeth include the press position (ML0) for meshing with the receiving tooth, and the sheet receiving position (ML3) spaced a predetermined distance away from the receiving tooth to receive the sheets in between the receiving tooth and the pressing teeth, and in the case of displacing the press position and performing multiple press binding on the bunch of sheets ST, are shifted to the intermediate position (ML4) between the press position and the sheet receiving position.

By this means, the separation distance between the pressing teeth and the receiving tooth is shortened in the case of performing press binding in a different position of the same bunch of sheets, and it is thereby possible to reduce the processing time of press binding in a plurality of portions.

In addition, in the description of the effects in the Embodiment in the foregoing, for each portion of this Embodiment, each component in the scope of the claims is shown in the parenthesis, or assigned the reference numeral to clarify the relationship between both the portion and the component.

The present invention is not limited to the above-mentioned Embodiments, various modifications thereof are capable of being made in the scope without departing from the invention, and all technical matters included in the technical ideas described in the scope of the claims are subjects of the invention. The Embodiments described previously illustrate preferred examples, a person skilled in the art is capable of achieving various types of alternative examples, corrected examples, modified examples or improved examples from the content disclosed in the present Description, and the examples are included in the technical scope described in the scope of the claims attached herewith.

This application claims priority from Japanese Patent Application No. 2016-118492 filed on Jun. 15, 2016 in Japan, Japanese Patent Application No. 2016-118641 filed on Jun. 15, 2016, Japanese Patent Application No. 2016-118642 filed on Jun. 15, 2016, and Japanese Patent Application No. 2016-128331 filed on Jun. 29, 2016, incorporated herein by reference.

What is claimed is:

1. A sheet processing apparatus comprising:

a placement tray adapted to place sheets transported in a transport direction; and a press bind unit adapted to press the sheets placed on the placement tray from a frontside and a backside of the sheets to perform press binding processing, wherein the press bind unit is provided with a receiving portion including an opening to receive a part of the sheets placed on the placement tray, a pair of pressing teeth that shifts along one end edge side of the sheets to perform the press binding processing at a first press bind position along the one end edge side of the sheets and thereafter perform the press binding processing at a second press bind position along the one end edge side of the sheets subjected to the press binding processing performed at the first press bind position, and a sheet guide provided in the receiving portion to guide the transported sheets into between the pair of pressing teeth, the apparatus is provided with a shift hold member that holds the sheet guide to shift between a guide position for narrowing the opening of the receiving portion to guide the transported sheets into between the pair of pressing teeth, and an expanded position for widening the opening wider than that in the guide position, when the pair of pressing teeth shifts to the first press bind position and the second press bind position to perform the press binding processing, in conjunction with a shift in a pressing direction of the pair of pressing teeth, and one of the pair of pressing teeth is able to shift among a press position for pressing the sheets to perform the press binding processing, a retract position separated from the sheets, and a receiving position located between the press position and the retract position for receiving the sheets, and the sheet guide shifts to the guide position and to the expanded position, corresponding to shifting of the one of the pair of pressing teeth to the receiving position and to the retract position.

2. The sheet processing apparatus according to claim 1, wherein the sheet guide is disposed to overlap a side portion of the one of the pair of pressing teeth, and further comprises a support member for supporting the one of the pair of pressing teeth which is the shift hold member for holding and shifting the sheet guide.

3. The sheet processing apparatus according to claim 2, wherein when the shift hold member shifts and holds the sheet guide to the guide position, the sheet guide covers a downstream side in the transport direction of the one of the pair of pressing teeth positioned in the receiving position, and is positioned nearer the sheet than the one of the pair of pressing teeth.

4. The sheet processing apparatus according to claim 3, wherein when the shift hold member shifts and holds the sheet guide to the expanded position, the sheet guide is held so as to overlap the side portion of the one of the pair of pressing teeth.

5. The sheet processing apparatus according to claim 4, wherein the one of pair of pressing teeth shifts perpendicularly to a surface of the sheets to be pressed, and the sheet guide is supported rotatably by the one of the pair of pressing teeth.

6. The sheet processing apparatus according to claim 2, wherein the support member is adapted to contact the sheet guide with a portion on an opposite side thereof to the one of the pair of pressing teeth supported by the support member for shifting and holding the sheet guide.

7. An image formation apparatus comprising:

an image formation section adapted to perform image formation on a sheet; and the sheet processing apparatus according to claim 1 adapted to perform the press binding processing on sheets transported from the image formation section.

8. A sheet processing apparatus comprising:

a placement tray adapted to place sheets transported in a transport direction;

a bind unit adapted to shift along one end edge side of the sheets and configured by providing together a press bind unit including a receiving portion including an opening to receive a part of the sheets placed on the placement tray, and provided with a pair of pressing teeth to press the sheets received in the opening from a frontside and a backside of the sheets to perform press binding processing at a first press bind position along the one end edge side of the sheets and thereafter perform the press binding processing at a second press bind position along the one end edge side of the sheets subjected to the press binding processing performed at the first press bind position, and a needle bind unit including a receiving part including an opening portion to receive a part of the sheets placed on the placement tray, and provided with a penetrating portion to penetrate a needle through the sheets received in the opening portion and a clincher to bend the needle through the sheets to perform needle binding processing on the sheets received in the opening portion at a first needle bind position along the one end edge side of the sheets with a needle penetrating the sheets, and thereafter to perform the needle binding processing at a second needle bind position along the one end edge side of the sheets subjected to the needle binding processing performed at the first needle bind position, a sheet guide adapted to guide the transported sheets into between the pair of pressing teeth of the press bind unit and into between the penetrating portion and the clincher of the needle bind unit, and a controller to control the sheet guide for changing a position of the sheet guide, wherein the sheet guide is able to be positioned in a guide position for narrowing the opening of the receiving portion to guide the sheets into between the pair of pressing teeth of the press bind unit and the opening portion of the receiving part to guide the sheets into between the penetrating portion and the clincher of the needle bind unit and in an expanded position for widening the opening and the opening portion wider than that in the guide position, and the controller controls the sheet guide to be held in the expanded position while the bind unit entirely shifts from the first press bind position to the second press bind position and from the first needle bind position to the second needle bind position along the one end edge side of the sheets.

9. The sheet processing apparatus according to claim 8, wherein the bind unit is configured to select the needle binding processing by the needle bind unit or the press binding processing by the press bind unit to perform on the sheets placed on the placement tray.

10. The sheet processing apparatus according to claim 9, wherein the sheet guide is disposed in the press bind unit.

11. The sheet processing apparatus according to claim 10, wherein in performing the press binding processing on the sheets with the press bind unit, the bind unit is shifted so that the press bind unit is positioned at the first press bind position or at the second press bind position, and the sheet guide is positioned in the guide position, before the sheets are placed on the placement tray.

12. The sheet processing apparatus according to claim 11, wherein in performing the needle binding processing on the sheets with the needle bind unit, the sheets are placed on the placement tray while the sheet guide is positioned in the expanded position, and subsequently, the bind unit is shifted so that the needle binding processing is performed at the first needle bind position and at the second needle bind position.

13. The sheet processing apparatus according to claim 11, further comprising a sheet shifting member to shift the sheets placed on the placement tray in a direction along the one end edge side of the sheets, wherein in performing the needle binding processing on the sheets placed on the placement tray with the needle bind unit, the sheet shifting member shifts the sheets along the one end edge side of the sheets so that the needle binding processing is performed subsequently.

14. An image formation apparatus comprising:

an image formation section adapted to perform image formation on a sheet; and the sheet processing apparatus according to claim 8 adapted to perform the press binding processing on sheets transported from the image formation section.

15. A sheet processing apparatus comprising:

a placement tray adapted to place sheets transported in a transport direction;

a press bind unit adapted to be able to shift along one end edge side of the sheets on the placement tray, wherein the press bind unit includes a receiving tooth, and a pressing tooth which meshes with the receiving tooth to press the sheets nipped therebetween to perform press binding processing, and the pressing tooth is provided to be able to shift among a receiving position spaced apart from the receiving tooth so as to receive a part of the sheets between the receiving tooth and the pressing tooth, a press position for meshing with the receiving tooth so as to perform the press binding processing at a first press bind position along the one end edge side of the sheets, and thereafter perform the press binding processing at a second press bind position along the one end edge side of the sheets subjected to the press binding processing performed at the first press bind position, and an intermediate position spaced apart from the receiving tooth between the press position and the receiving position; and a controller to control the pressing tooth to be held in the intermediate position during the entire shift of the press bind unit along the one end edge side of the sheets from the first press bind position to the second press bind position with the sheets disposed between the receiving tooth and the pressing tooth.

16. The sheet processing apparatus according to claim 15, wherein after the press binding processing at the first press bind position, while the pressing tooth is shifted to the intermediate position, the press bind unit starts to shift to the second press bind position along the one end edge side of the sheets, and then the pressing tooth is shifted again to the press position from the intermediate position.

17. The sheet processing apparatus according to claim 15, wherein the press bind unit is further provided with a needle bind unit including an opening portion to receive a part of the sheets, the needle bind unit being disposed on a side of the press bind unit so as to shift together with the press bind unit in a shift direction of the press bind unit for performing needle binding processing on the sheets with a needle at a plurality of needle bind positions along the one end edge side of the sheets, wherein when the needle bind unit shifts to the plurality of needle bind positions along the one end edge side of the sheets to perform the needle binding processing, the pressing tooth shifts to a retract position spaced apart from the receiving tooth farther than the receiving position, and a distance between the retract position and the receiving tooth in a thickness direction of the sheets is substantially equal to a dimension of the opening portion in the thickness direction of the sheets.

18. The sheet processing apparatus according to claim 17, wherein the press bind unit includes a sheet guide to guide the sheets to undergo the press binding processing to between the pressing tooth and the receiving tooth when the pressing tooth is in the receiving position, and the sheet guide is in conjunction with operation of the pressing tooth for shifting between the receiving position and the retract position.

19. The sheet processing apparatus according to claim 18, wherein when the pressing tooth is in the intermediate position, the sheet guide is out of conjunction with a shift of the pressing tooth.

20. An image formation apparatus comprising:

an image formation section adapted to perform image formation on a sheet; and the sheet processing apparatus according to claim 15 adapted to perform the press binding processing on sheets transported from the image formation section.

* * * * *